US009064391B2

(12) United States Patent
Vardi et al.

(10) Patent No.: US 9,064,391 B2
(45) Date of Patent: Jun. 23, 2015

(54) TAMPER-ALERT RESISTANT BANDS FOR HUMAN LIMBS AND ASSOCIATED MONITORING SYSTEMS AND METHODS

(71) Applicant: TechIP International Limited, Nicosia (CY)

(72) Inventors: Eyal Dov Vardi, Bet Nir (IL); Dov Ehrman, Jerusalem (IL)

(73) Assignee: TECHIP INTERNATIONAL LIMITED, Nicosia (CY)

( * ) Notice: Subject to any disclaimer, the term of this patent is extended or adjusted under 35 U.S.C. 154(b) by 0 days.

(21) Appl. No.: 13/741,937

(22) Filed: Jan. 15, 2013

(65) Prior Publication Data

US 2013/0182382 A1 Jul. 18, 2013

Related U.S. Application Data

(63) Continuation-in-part of application No. 13/331,648, filed on Dec. 20, 2011, now Pat. No. 8,736,447.

(51) Int. Cl.

| | |
|---|---|
| ***G08B 13/14*** | (2006.01) |
| ***G08B 13/02*** | (2006.01) |
| *G08B 21/02* | (2006.01) |

(52) U.S. Cl.

CPC ..... *G08B 13/02* (2013.01); *G08B 13/1463* (2013.01); *G08B 21/0288* (2013.01)

(58) Field of Classification Search

USPC ..... 340/568.1–568.2, 539.13, 572.1–572.9, 340/568.6, 568.8, 571, 686.6, 691.6, 692

See application file for complete search history.

(56) References Cited

U.S. PATENT DOCUMENTS

| | | | | |
|---|---|---|---|---|
| 4,598,275 | A | 7/1986 | Ross et al. | |
| 4,819,860 | A | 4/1989 | Hargrove et al. | |
| 5,014,040 | A | 5/1991 | Weaver et al. | |
| 5,075,670 | A | 12/1991 | Bower et al. | |
| 5,204,670 | A | 4/1993 | Stinton | |
| 5,216,909 | A | 6/1993 | Armoogam | |
| 5,218,344 | A | 6/1993 | Ricketts | |
| 5,298,884 | A | 3/1994 | Gilmore et al. | |
| 5,589,840 | A | 12/1996 | Fujisawa | |
| 5,742,256 | A | 4/1998 | Wakabayashi | |
| 5,977,877 | A | 11/1999 | McCulloch et al. | |
| 6,094,747 | A * | 8/2000 | Malick | 2/159 |
| 6,104,295 | A | 8/2000 | Gaisser et al. | |
| 6,112,563 | A | 9/2000 | Ramos | |
| 6,218,945 | B1 | 4/2001 | Taylor, Jr. | |
| 6,225,906 | B1 | 5/2001 | Shore | |

(Continued)

FOREIGN PATENT DOCUMENTS

| | | |
|---|---|---|
| DE | 3049091 A1 | 7/1982 |
| GB | 2465849 A | 6/2010 |

(Continued)

OTHER PUBLICATIONS

Office Action issued in U.S. Appl. No. 13/331,648 dated Aug. 23, 2013.

*Primary Examiner* — Daniel Previl

(74) *Attorney, Agent, or Firm* — Nixon & Vanderhye, P.C.

(57) ABSTRACT

A tamper alert band is provided that includes a strap with conductive and non-conductive elements or layers. The tamper alert band includes an electronic or RFID device that is configured to communicate with RFID readers and/or exciters. The strap may be a single unitary body that has a conductive layer and a non-conductive layer.

16 Claims, 21 Drawing Sheets

(56) References Cited

U.S. PATENT DOCUMENTS

| | | | |
|---|---|---|---|
| 6,236,319 | B1 | 5/2001 | Pitzer et al. |
| 6,305,605 | B1 | 10/2001 | Goetz et al. |
| 6,424,264 | B1 | 7/2002 | Giraldin et al. |
| 6,472,989 | B2 | 10/2002 | Roy, Jr. |
| 6,529,136 | B2 | 3/2003 | Cao et al. |
| 6,727,817 | B2 | 4/2004 | Maloney |
| 6,747,562 | B2 | 6/2004 | Giraldin et al. |
| 6,753,782 | B2 | 6/2004 | Power |
| 6,813,916 | B2 | 11/2004 | Chang |
| 6,853,304 | B2 | 2/2005 | Reisman et al. |
| 6,888,502 | B2 | 5/2005 | Beigel et al. |
| 6,963,277 | B2 | 11/2005 | Imasaki et al. |
| 6,998,984 | B1 | 2/2006 | Zittrain et al. |
| 7,030,765 | B2 | 4/2006 | Giraldin et al. |
| 7,084,764 | B2 | 8/2006 | McHugh et al. |
| 7,098,792 | B1 | 8/2006 | Ahlf et al. |
| 7,114,647 | B2 | 10/2006 | Giraldin et al. |
| 7,123,141 | B2 | 10/2006 | Contestabile |
| 7,132,944 | B1 | 11/2006 | Kron et al. |
| 7,151,445 | B2 | 12/2006 | Medve et al. |
| 7,158,030 | B2 | 1/2007 | Chung |
| 7,239,238 | B2 | 7/2007 | Tester et al. |
| 7,240,446 | B2 | 7/2007 | Bekker |
| 7,242,306 | B2 | 7/2007 | Wildman et al. |
| 7,256,681 | B1 | 8/2007 | Moody et al. |
| 7,312,709 | B2 | 12/2007 | Kingston |
| 7,324,000 | B2 | 1/2008 | Zittrain et al. |
| 7,327,251 | B2 | 2/2008 | Corbett, Jr. |
| 7,355,514 | B2 | 4/2008 | Medve et al. |
| 7,374,081 | B2 | 5/2008 | Mosher, Jr. |
| 7,382,268 | B2 | 6/2008 | Hartman |
| 7,468,666 | B2 | 12/2008 | Ciarcia, Jr. et al. |
| 7,479,891 | B2 | 1/2009 | Boujon |
| 7,498,943 | B2 | 3/2009 | Medve et al. |
| 7,554,446 | B2 | 6/2009 | Ciarcia, Jr. et al. |
| RE41,171 | E | 3/2010 | Howe, Jr. |
| 7,701,332 | B2 | 4/2010 | Anderson |
| 7,714,725 | B2 | 5/2010 | Medve et al. |
| 7,994,916 | B2 | 8/2011 | Kron et al. |
| 8,001,235 | B2 | 8/2011 | Russ et al. |
| 8,138,886 | B1 | 3/2012 | Chang |
| 8,185,411 | B2 | 5/2012 | Allard et al. |
| 8,416,081 | B2 | 4/2013 | Kron et al. |
| 8,736,447 | B2 | 5/2014 | Ehrman et al. |
| 2002/0035484 | A1 | 3/2002 | McCormick |
| 2002/0070865 | A1 | 6/2002 | Lancos et al. |
| 2002/0075151 | A1 | 6/2002 | Lancos et al. |
| 2003/0174059 | A1 | 9/2003 | Reeves |
| 2003/0218539 | A1* | 11/2003 | Hight ..... 340/539.13 |
| 2004/0080421 | A1 | 4/2004 | Wunderlich |
| 2004/0174264 | A1 | 9/2004 | Reisman et al. |
| 2005/0240441 | A1 | 10/2005 | Suzuki et al. |
| 2006/0089538 | A1 | 4/2006 | Cuddihy et al. |
| 2006/0131391 | A1* | 6/2006 | Penuela ..... 235/380 |
| 2006/0187065 | A1* | 8/2006 | Girvin et al. ..... 340/572.9 |
| 2007/0008138 | A1* | 1/2007 | Mosher et al. ..... 340/572.4 |
| 2007/0017136 | A1 | 1/2007 | Mosher et al. |
| 2007/0116036 | A1 | 5/2007 | Moore |
| 2007/0194099 | A1 | 8/2007 | Miller et al. |
| 2008/0028654 | A1 | 2/2008 | Cardon et al. |
| 2008/0051667 | A1* | 2/2008 | Goldreich ..... 600/481 |
| 2008/0057976 | A1 | 3/2008 | Rae et al. |
| 2008/0126126 | A1 | 5/2008 | Ballai |
| 2008/0126417 | A1 | 5/2008 | Mazurik |
| 2008/0211677 | A1 | 9/2008 | Shecter |
| 2009/0203971 | A1 | 8/2009 | Sciarappa et al. |
| 2009/0224889 | A1 | 9/2009 | Aggarwal et al. |
| 2009/0315716 | A1* | 12/2009 | Lerch et al. ..... 340/568.2 |
| 2010/0089108 | A1 | 4/2010 | Dutt et al. |
| 2010/0174229 | A1 | 7/2010 | Hsu et al. |
| 2010/0238033 | A1 | 9/2010 | Blumel et al. |
| 2011/0025852 | A1 | 2/2011 | Tanaka |
| 2011/0050411 | A1 | 3/2011 | Schuman et al. |
| 2011/0111736 | A1 | 5/2011 | Dalton et al. |
| 2011/0127325 | A1 | 6/2011 | Hussey et al. |
| 2011/0128145 | A1 | 6/2011 | Todd et al. |
| 2011/0266343 | A1 | 11/2011 | Liu |
| 2012/0050532 | A1 | 3/2012 | Rhyins |
| 2012/0086573 | A1 | 4/2012 | Bischoff et al. |
| 2013/0069514 | A1 | 3/2013 | Hashemi et al. |
| 2013/0121658 | A1 | 5/2013 | Kiet et al. |

FOREIGN PATENT DOCUMENTS

| | | |
|---|---|---|
| JP | 2004-46582 | 2/2004 |
| WO | WO 2008-144952 | 12/2008 |

* cited by examiner

TAMPER-ALERT RESISTANT BANDS FOR HUMAN LIMBS AND ASSOCIATED MONITORING SYSTEMS AND METHODS

CROSS-REFERENCE TO RELATED APPLICATIONS

This application is a continuation-in-part of U.S. application Ser. No. 13/331,648, filed Dec. 20, 2011, the entire contents of which are hereby incorporated by reference.

FIELD

The technology herein generally relates to tamper-alert bands, tamper-resistant bands, related monitoring systems, and methods.

BACKGROUND AND SUMMARY

Wristbands are used for a variety of different purposes such as, e.g., to retain a wristwatch, to indicate admittance to a popular concert or nightclub; to provide identifying information for a hospital patient, and the like. In these examples, the wristband provides information to the person (e.g., the time) or provides information about the person (e.g., their name).

More recently some types of wristbands have included the capability to electronically store information. For instance, a hospital band may include information about the patient. In certain instances, such bands may also include radio frequency identification (RFID) devices that allow remote access to information stored therein. Such information may include, e.g., the name, age, and associated medical conditions of the patient.

Wristbands are typically secured to the wrist of a person through the use of a buckle, elastic members or simply mechanically constricting the band enough so that it will not slide off the hand of the person (e.g., a handcuff). Other types of bands may enable more sophisticated security schemes. One example of this is electronic monitoring. An electronic monitoring anklet may be locked into place and not removable without a specific key. If the anklet is somehow removed (e.g., cut) then an alert may be triggered. Such a device is then both tamper resistant (e.g., due to the key requirement) and tamper alert (due to the alert that is triggered when cut).

However, these types of bands may be complex in operation and may be prone to false alarms or the like. Thus, it will be appreciated that new and interesting techniques in this area are continually sought.

In certain example embodiments, a tamper alert RFID wristband is provided. An example wristband may combine two materials. A first layer of conductive material and a second layer of non-conductive material. The conductive layer may include a conductive thermoplastic elastomer or other type of material that is conductive (e.g., contains conductive carbon and/or metal particles). In certain examples, the material may be same material (e.g., rubber) but one layer portion thereof may be made conductive (e.g., due to conductive carbon loading) and the other may remain non-conductive.

In certain examples, an RFID chip may connect the conductive material or layers to form a closed circuit when the wristband is closed. However, when the wristband is opened (e.g. cut or unfastened or otherwise removed) the normally conductive circuit is opened.

In certain examples, a non-conductive layer may provide a buffer such that the above noted electrical circuit remains open until the wristband is closed. The non-conductive material or layer may separate two or more conductive layers and be used as a base for holding an RFID chip, display and/or related circuitry/transducers.

According to certain example embodiments, the shape and/or placement of the conductive material may increase surface contact area provided for establishing a closed circuit and thus possibly decrease the prevalence of false alarms. Certain example embodiments may decrease (or even eliminate) the need for additional pins or other materials that otherwise may be needed to ensure that the circuit is closed on the wristband. As a result of certain example structural implementations, possibly adverse impacts of dirt, humidity, liquids, or other environmental factors may be reduced.

In certain examples, if the tamper monitor circuit is opened, an active RFID chip of the wristband may submit an alert a central messaging server. Such an alert may include information such as patient location, status, patient ID, or the like associated with the patient's assigned wristband.

An example RFID tamper alert wristband may include an advanced level of identification and tracking. In certain examples, the wristband includes a micro-computer chip and RF (radio frequency) antenna which allows the information to be written and retrieved by RFID readers and/or exciters. The following example actions may trigger a tamper alert: 1) cutting the wristband; 2) opening the wristband without authorization; 3) the battery on the wristband becoming low; 4) detection of the wristband being in an unauthorized location or outside an authorized location; and 5) detection of the wristband failing to "ping" a central server for more than, for example, 60 seconds, and the like. In certain examples, each trigger (e.g., examples 1-5 above) may correspond to a different identified type of alert. For example, a critical message notification may be triggered when the wristband is cut or a service level notification may be triggered if battery power on the wristband is detected below a certain threshold.

BRIEF DESCRIPTION OF THE DRAWINGS

These and other features and advantages will be better and more completely understood by referring to the following detailed description of exemplary non-limiting illustrative embodiments in conjunction with the drawings of which.

DETAILED DESCRIPTION OF PREFERRED EMBODIMENTS

The following description is provided in relation to several example embodiments that may share common characteristics and/or features. It is to be understood that one or more features of any of the embodiments may be combinable with one or more features of other example embodiments. In addition, any single feature or combination of features in any of the embodiments may constitute an additional embodiment.

The example embodiments described herein may relate to bands worn on an extremity of a person. For example, the wrist of a patient at a hospital, the ankle of an inmate at a prison, a wrist of a child at an amusement park. In certain example embodiments, a band may include a radio frequency identification (RFID) device that stores information and/or communicates with external sensors to track the positional location of the band (and thus the person wearing the band). Example bands may include a tamper alert structure that is configured to provide an alert when the band is removed or otherwise tampered with. Certain example bands may include a tamper-resistant structure that structurally prevents removal of the band from an extremity (e.g., ankle or wrist) of the user wearing the band.

Figure 1:
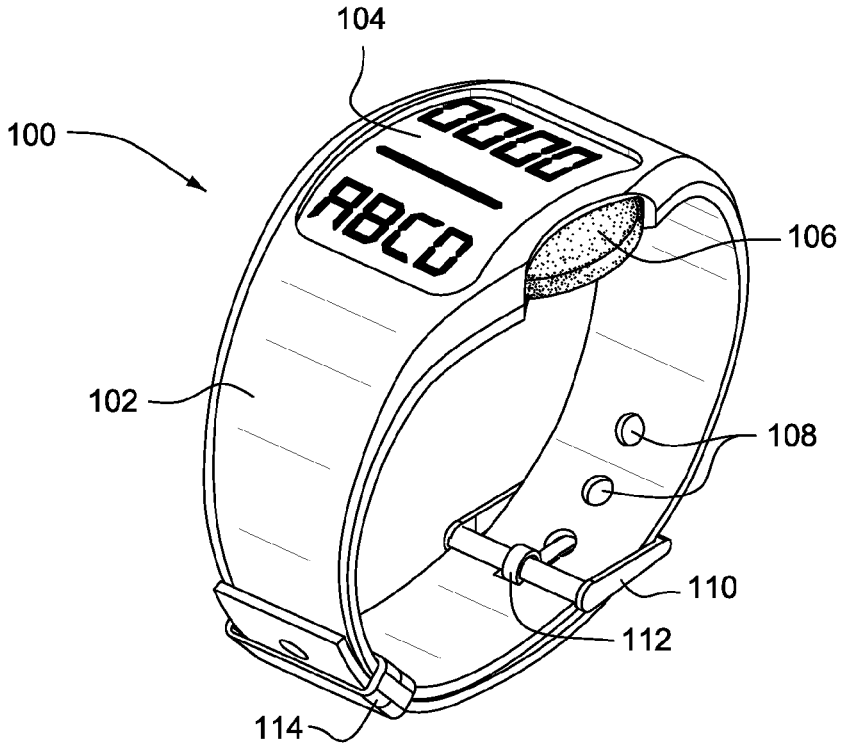
FIG. 1 is a perspective view of a band according to certain example embodiments.

FIG. 1 is a perspective view of an example band according to certain example embodiments. Band 100 includes a strap 102 (e.g., a bracelet) that is designed to wrap about a wrist, ankle, etc of a wearer. Band 100 includes a display screen 104 that is disposed or embedded into the strap. The display screen 104 may be used to visually display information to a wearer of the band or to another user (e.g., a nurse, attendant or physician). In certain example embodiments, the display screen may include a liquid crystal display (LCD). It will be appreciated that other display screen types may be implemented according to certain example embodiments. For example, segment displays that light up to display predetermined screen information (e.g., a number or the like). The display 104 may be implemented to visually display information stored on an internal memory storage device (e.g., and RFID chip or the like). An LCD screen that can display text or images and/or an LED light can provide light in different colors.

A switch actuating button 106 may be provided in the band 100. In certain instances the button may be integrated with the display 104 and/or an RFID device (described below) such that pressing the button triggers a new display message on the display 104 and/or some pre-determined functionality via the RFID chip. For example, the button 106 may be an emergency switch button that triggers an alert for staff when a patient/resident requires help or attention.

The strap 102 of the band 100 can include multiple fastening holes 108 that are structured to accept, e.g., a rotatable latch pin 112 that is attached to clasp 110. The connection of one end of the strap 102 to the other end of the strap 102 (and/or forced intimate inter-contacting areas) may thereby complete an electrical circuit (described in more detail below). The strap 102 may also be comfortably inserted into an end retention loop 114 to neatly hold excess strap lengths (and, e.g., enhance electrical contact between conductive ends of the band 100).

Figure 2:
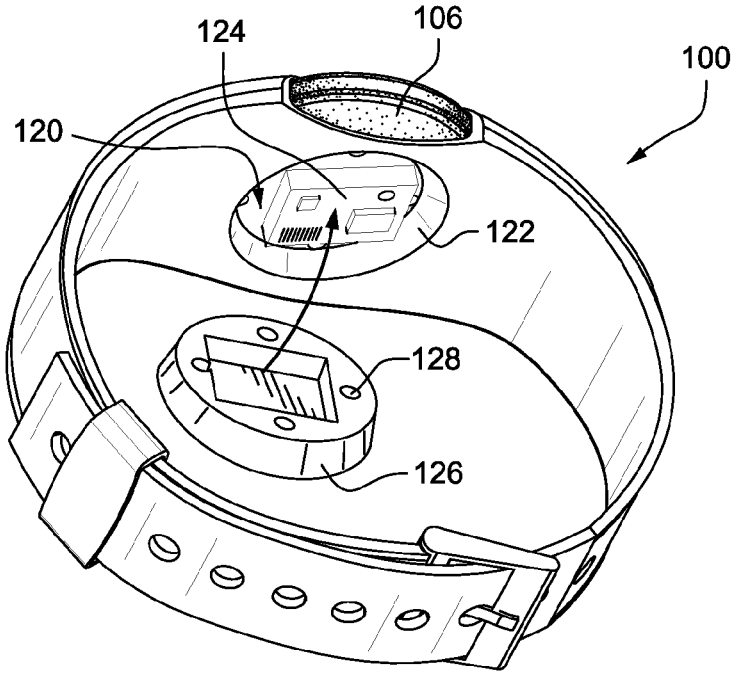
FIG. 2 is another perspective view showing an underside of the band in FIG. 1.

FIG. 2 is another perspective view showing an underside of the band 100 in FIG. 1. Band 100 includes a cavity 120 that may be integrally formed (e.g., by a mold insert) when the band is first constructed (e.g., by a molding operation). The cavity 120 is formed with sidewalls 122 that, in this example, are tapered slightly outwardly towards the proximal side of the cavity. The cavity is dimensioned to accept the placement of an RFID device 124 or other electronic device (e.g., a computer chip and/or printed circuit board—PCB). Once the RFID device 124 has been placed into the cavity, a closure cap 126 may be pressed (or otherwise secured) into the cavity to thereby retain and/or seal the RFID device 124 into body of the band 100. In certain examples, fasteners (e.g., bolts, screws, or the like) may be used to secure the cap 126 to the body. The cap may then function to protect the RFID device 124 from outside elements and/or unauthorized access.

Figure 3A:
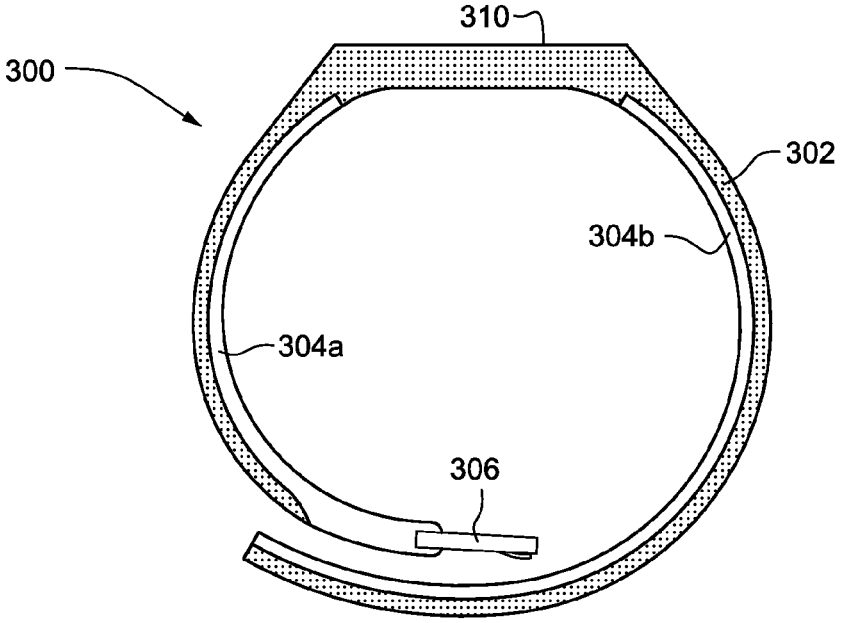
FIG. 3A is a side view of an example band according to certain example embodiments.
Figure 3B:
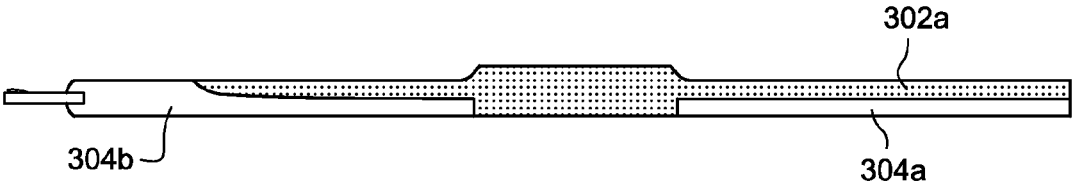
FIG. 3B is another side view of the example band shown in FIG. 3A with the band extended lengthwise.
Figure 3C:
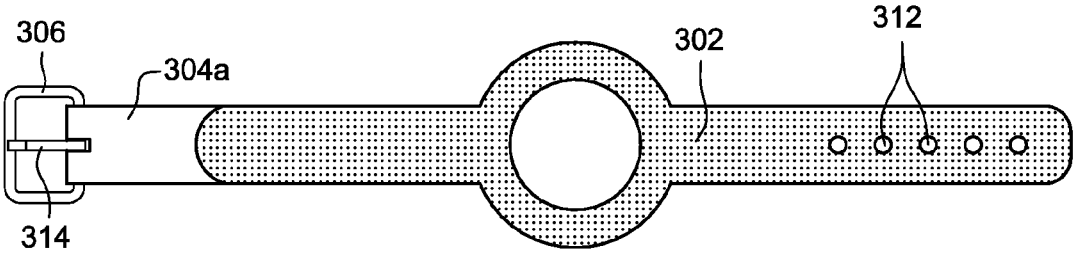
FIG. 3C is a top down view of the example band shown in FIG. 3A.
Figure 3D:
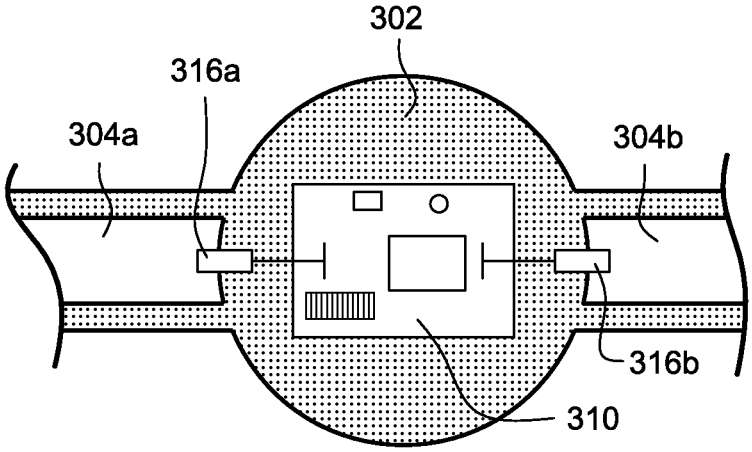
FIG. 3D is a cutout cross section schematic view of the example band shown in FIG. 3A.

FIGS. 3A-3D are four separate views of an example band. FIG. 3A is a side view (in an unfastened state), FIG. 3B is another side view where the unfastened band is extended lengthwise, FIG. 3C is a top down view of the extended band, and FIG. 3D is a cutout cross sectional schematic view of a central cavity portion of band 300. Band 300 includes a top central portion 310 that may include an LCD as described herein. In certain example embodiments, the top portion may include a switch button. The band 300 is formed out of a unitary length of material having a non-conductive "top" layer 302 and an electrically conductive bottom layer that includes conductive portion 304*a* and 304*b*. As shown in FIG. 3A, a non-conductive gap at a central portion of the band 300 is formed between portion 304*a* and 304*b* where the top portion 310 is located. A buckle 306 with a rotatable latch pin 314 may be used to secure the respective ends of the band 300 in the usual manner through fastening holes 312.

FIG. 3D shows a schematic cutout central portion view of band 300 where conductive layer portion 304*a* and conductive layer portion 304*b* are conductively connected via RFID device (e.g., a small PCB having an RFID device, microcomputer, etc) 310 that connects to respective connectors 316*a* and 316*b* (e.g., to PCB I/O pins positioned on each side of the central gap between the respective conductive portions 304*a* and 304*b*). Thus, when the band 300 is wrapped around, for example, the wrist of a person, an exposed free end "lower" side of conductive portion 304*a* may come into conductive contact with the now free end "upper" side of conductive portion 304*b*. In certain instances the buckle 306 and latch 314 may connect to other end of the band 300 and the conductive portion 304*b*. With the two conductive portions linked thus by fastening the band about a wearer's extremity, a closed circuit is formed through the RFID device 310 and along the respective lengths and ends of conductive portions 304*a* and 304*b*.

As noted above, the non-conductive and conductive layers may form a single unitary strap or band body. In certain instances, both layers are formed out of a rubber material by a molding process. Thus the non-conductive top layer 302 may be formed of rubber (which may extend downward at the outside edges so as to present a single edge appearance)—e.g., by casting a molten thermoplastic material into a forming mould. In certain example embodiments, layer 302 may be "loaded" with colored particles so as to present a portion (or all) of a layer or the band with a desired colored appearance to the observer after being placed about a wrist or other limb. Second conductive partial layers 304*a* and 304*b* may be formed by a separate casting of molten thermoplastic material into the mold—or conductive particles may be selectively injected into portions of the molten material to create conductive layers 304*a* and 304*b*. The use of an integrally molded structure with two or more layers may be thus provided having increased strength and aesthetically attractive wristband for users. Certain example embodiments may decrease the use of carbon-loaded rubber (e.g., because such use may leave black marks on the skin of a user if rubbed). Other embodiments may use conductive nano-particles of a metal or other electrically conductive material to conductively load and create an integral structure.

In certain example embodiments, a wristband may be constructed with a double injection molding process where the non-conductive base layer is molded and then the conductive layer is further molded to the non-conductive base layer. The molding of the non-conductive layer may include molding around a mold insert defining a cavity that is designed to hold a PCB or other electronic device as discussed herein.

Figure 4A:
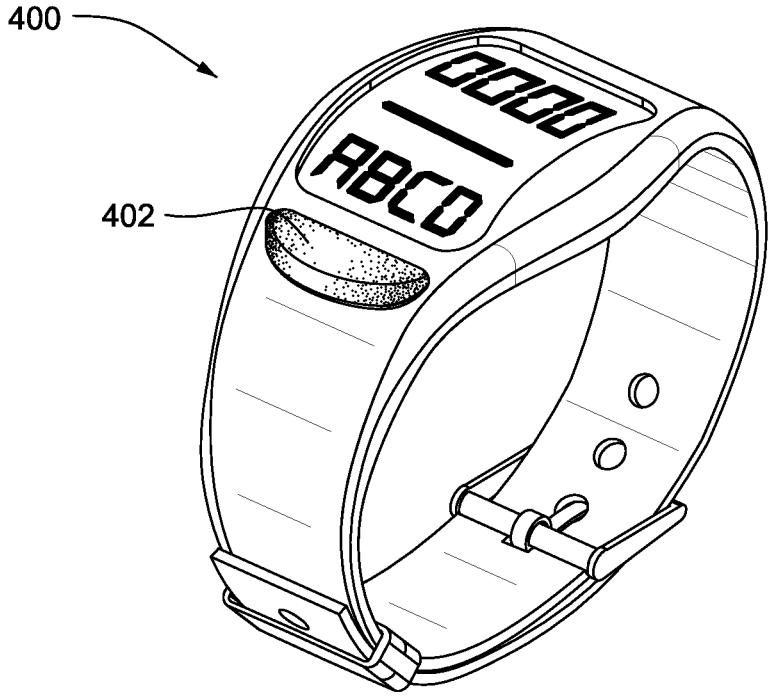
FIGS. 4A and 4B are perspective views of example bands according to certain example embodiments.
Figure 4B:
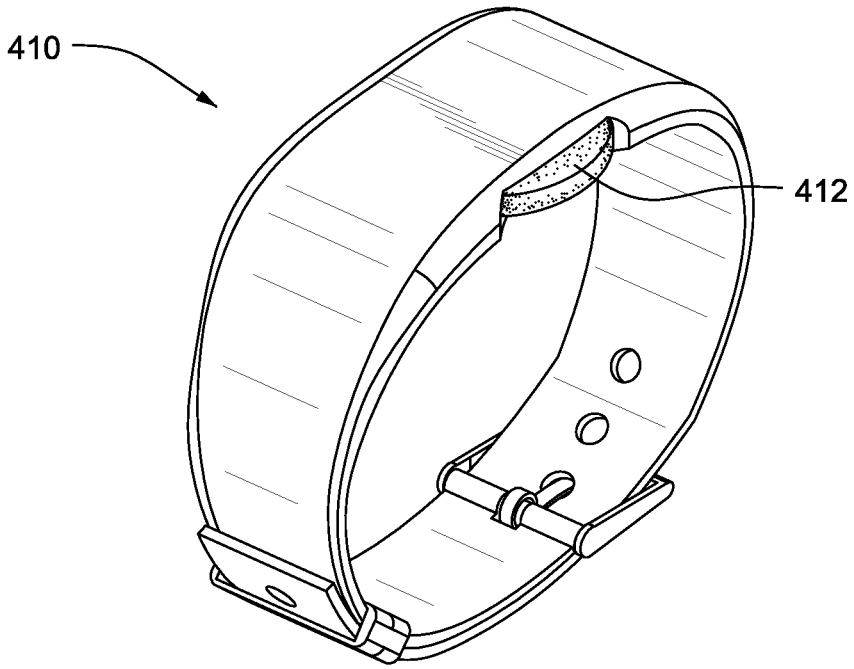

FIGS. 4A and 4B are perspective views of example bands. In FIG. 4A an example band 400 includes a switch button 402 that is placed inline with the strap that forms part of the band 400 (where it can easily be actuated by a user squeezing together the thumb and a forefinger). In FIG. 4B, a switch button 412 is placed along the side of the band 410 (where it can also be easily actuated by squeezing together the thumb and forefinger). The band 410 may or may not include a display screen or the like. In other words, certain example embodiments may include a display screen, while others do not (albeit even if a display screen is not provided, a writing surface may be provided where information can be written, marked or otherwise affixed). Certain example embodiments may include a switch button along a side of the band, on top of the band (e.g., without an LCD), or inline with a band. Thus, it will be appreciated that many different types of configurations are contemplated.

Figure 5A:
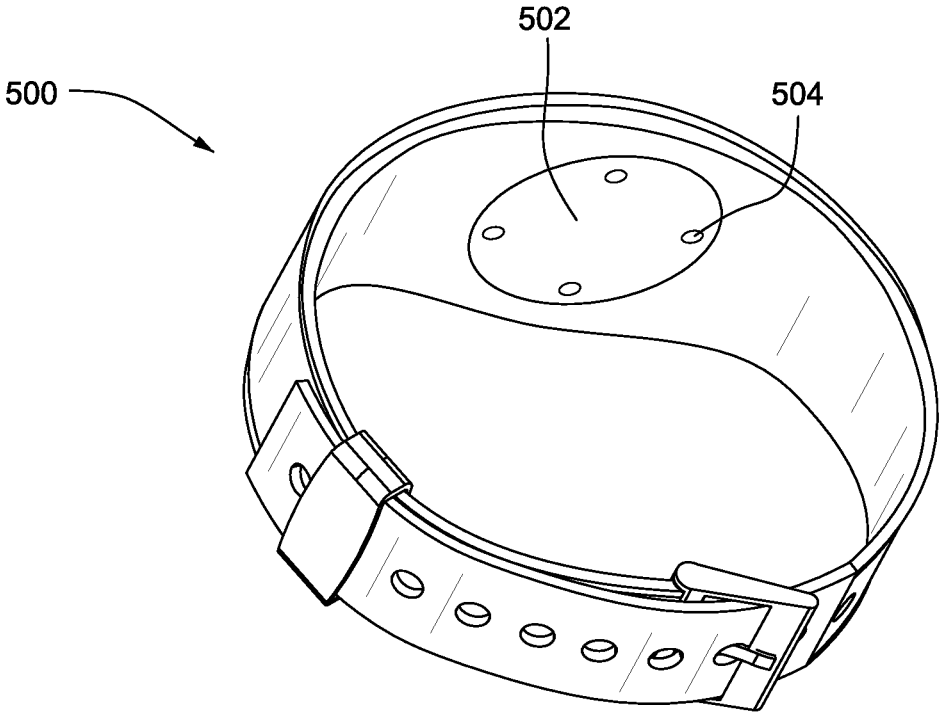
FIGS. 5A and 5B are perspective views showing the underside of example bands according to certain example embodiments.
Figure 5B:
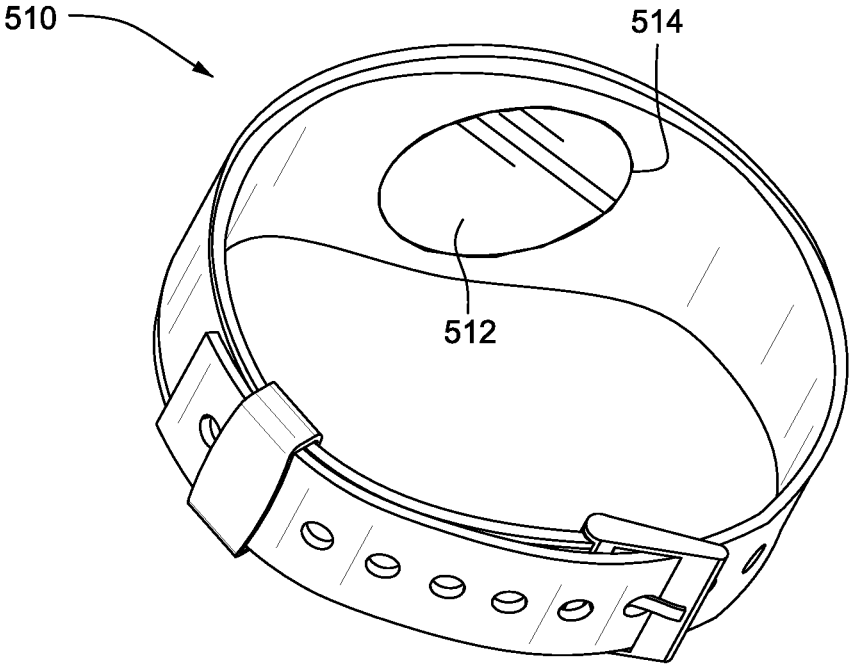

FIGS. 5A and 5B are perspective views showing the underside of example bands according to certain example embodiments. As described in connection with FIG. 2 a plug may be used to cover up a mating recess that includes a PCB (e.g., incorporating an RFID device). As shown in FIG. 5A, a band 500 includes a plug 502 that is secured to the band 500 with screws 504. Thus the screws may operate to secure the plug to the band and protect the enclosed RFID device. It will be appreciated that while the embodiment in FIG. 5A may employ screws, other types of fasteners may be employed. For example, a bolt, peg, pin, rivet, a screw with a gasket, or other device may be used to secure a plug 502 to a band according to various embodiments. As will be appreciated, such fasteners may be shaped so that they can be installed and/or removed only by use of special tools.

FIG. 5B shows another type of mounting for a plug 512 to a band 510. In this example, the plug is placed into a recess to cover an RFID device and ultrasonic welding is used along crease 514 to more permanently secure the plug to the main body of the band 510. Other techniques for securing plug 512 to band 510 may also be employed. For example, an adhesive such as glue may be used.

As described above, certain example bands may use buckles to secure the respective ends of the band together around the wrist of a user. However, other techniques for securing the ends of a band may be used.

Figure 6:
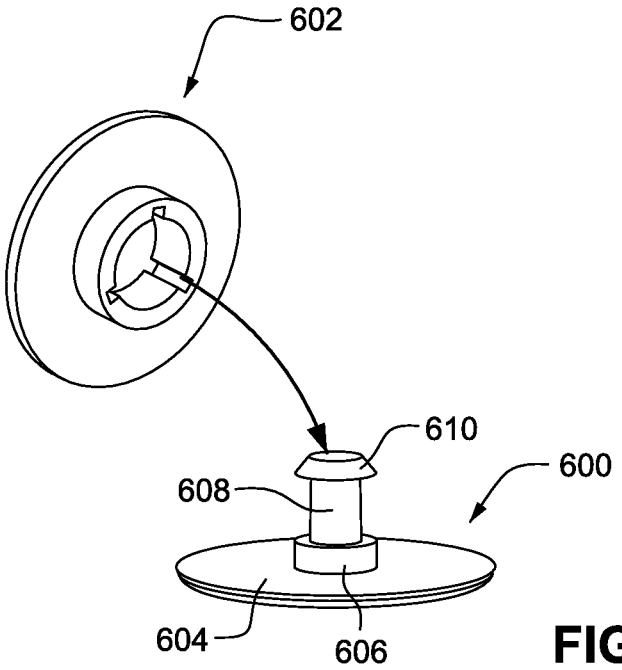
FIG. 6 is a illustrative view of an example band-locking fastener used in conjunction with certain example embodiments.

FIG. 6 is an illustrative view of an example locking fastener used in conjunction with certain example embodiments. A snap-type rivet fastener 600 includes a disc-shaped base portion 604, a vertical stem 608, a base washer 606, and a radially extending lip portion 610. A mating cap 602 is structured be placed over the deformable lip 610 and to snap into place around the vertical stem 608 under lip 610. In certain example embodiments, a snap fastener may be used to secure respective ends of the band instead of, or in addition to, the various buckles described herein.

A snap fastener and/or cap used therewith may be made out of plastic. However, in certain example embodiments, all or a portion of a snap fastener (and its cap) may be constructed out of a conductive material (e.g., a plastic loaded with conductive particles). Such a conductive material may then be used to itself "close" (or assist in closing) the electrical circuit formed by, for example, the conductive layer portions that form part of an example band.

Figure 7:
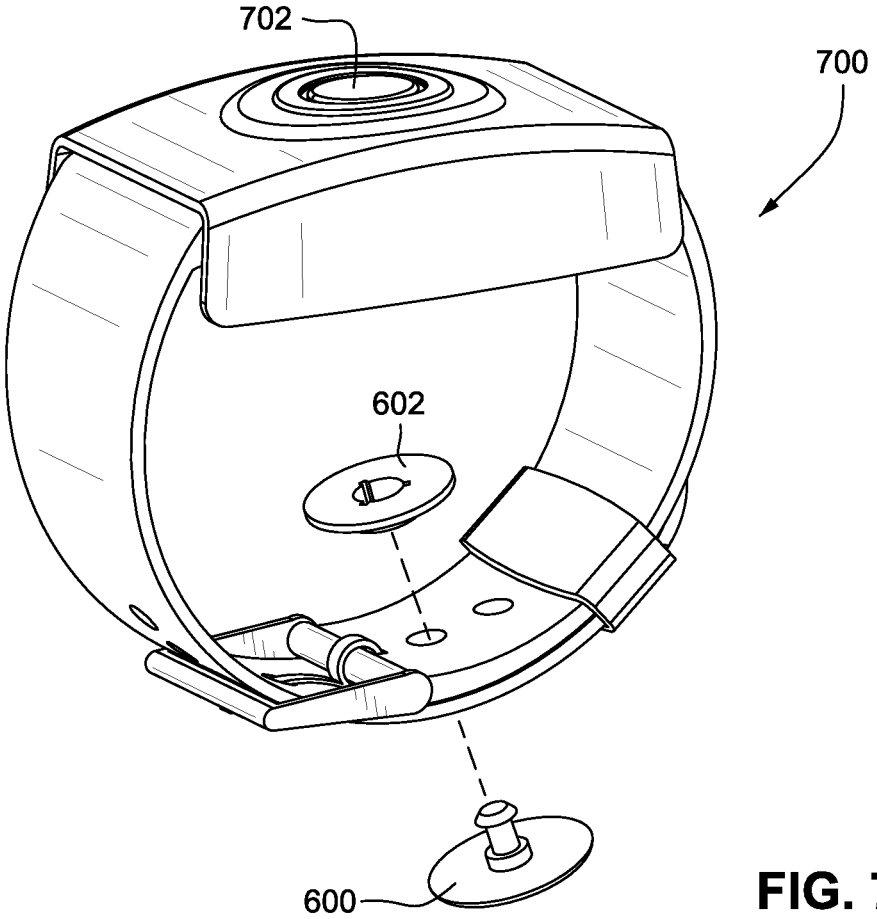
FIGS. 7-9 are perspective views of an example band employing the locking fastener of FIG. 6 according to certain example embodiments.
Figure 8:
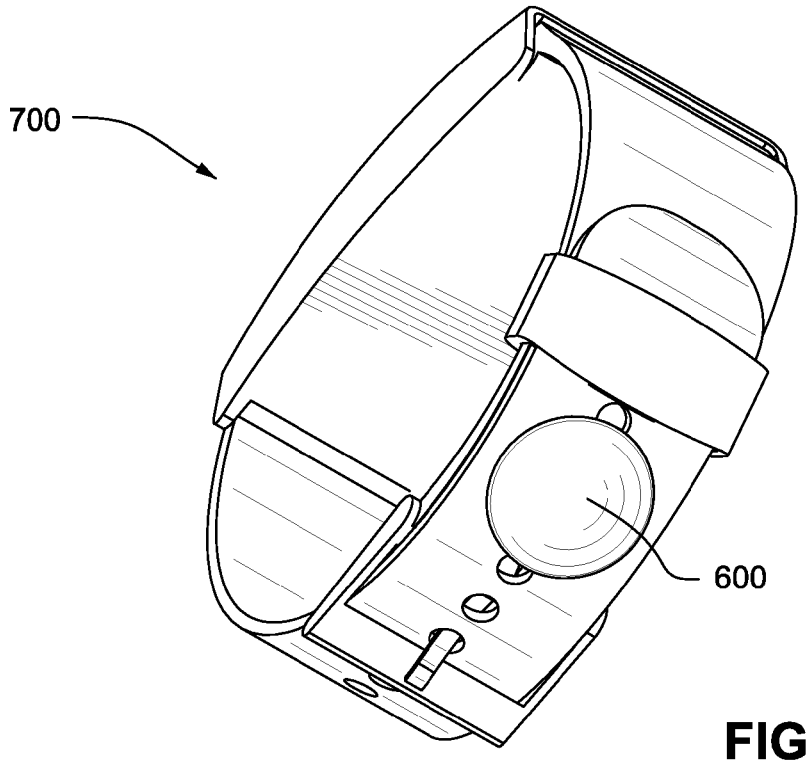
Figure 9:
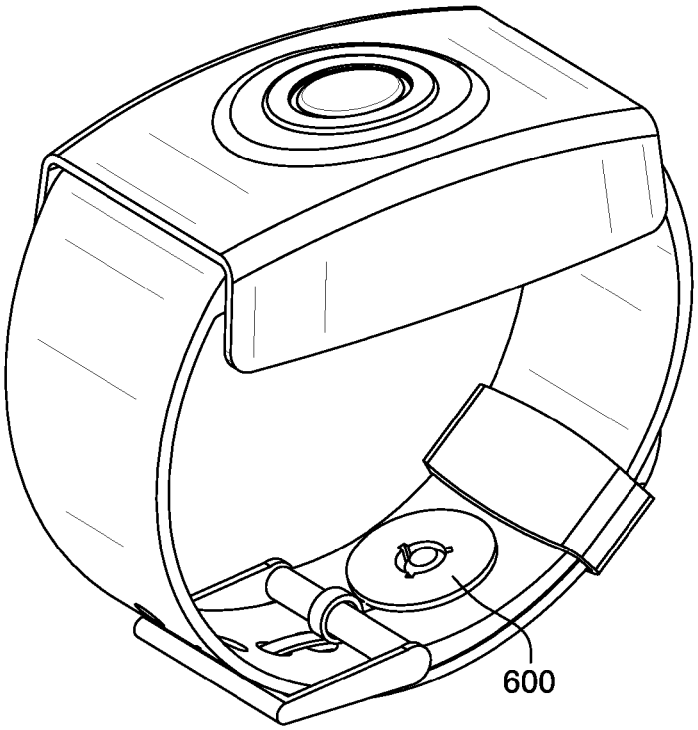

FIGS. 7-9 are perspective views of an example band employing the locking fastener of FIG. 6 according to certain example embodiments. The band 700 includes a centrally placed switch button 702 (e.g., to initiate a user-actuated help alarm). The snap fastener 600 is placed through mated holes in the band 700 (when it is properly fitted around a user's extremity, such as a wrist) to snap together with cap 602 to secure the respective ends of band 700.

Figure 10A:
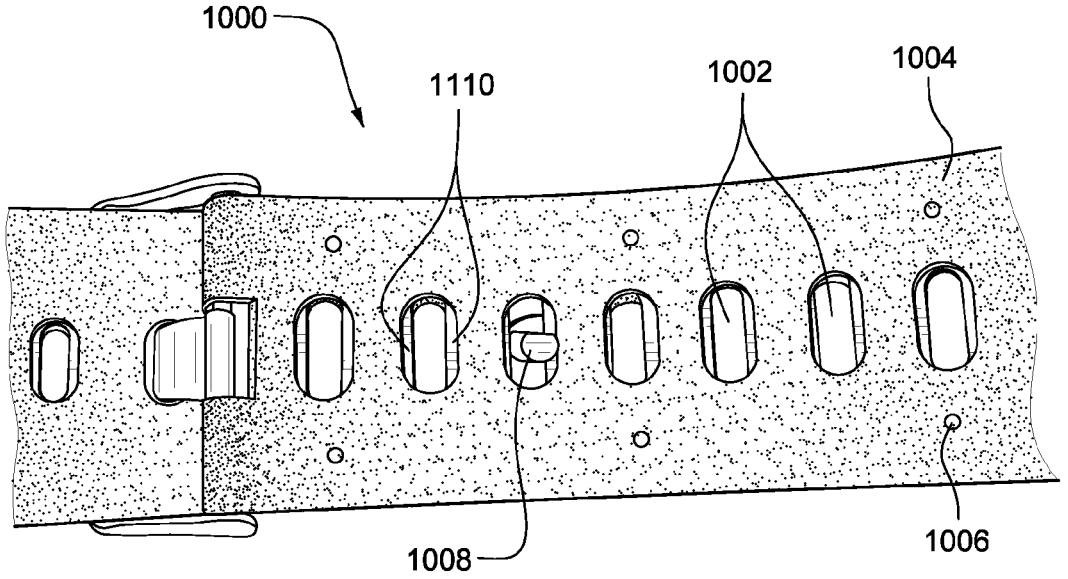
FIGS. 10A-11 are cutout views of an example strap with another example locking fastener according to certain example embodiments.
Figure 10B:
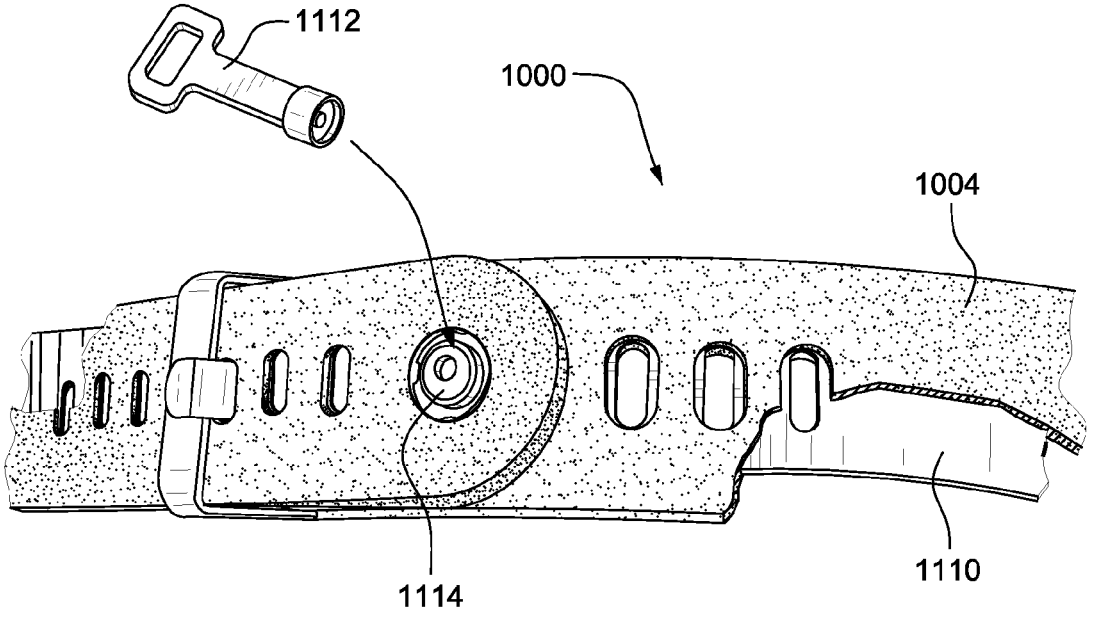
Figure 10C:
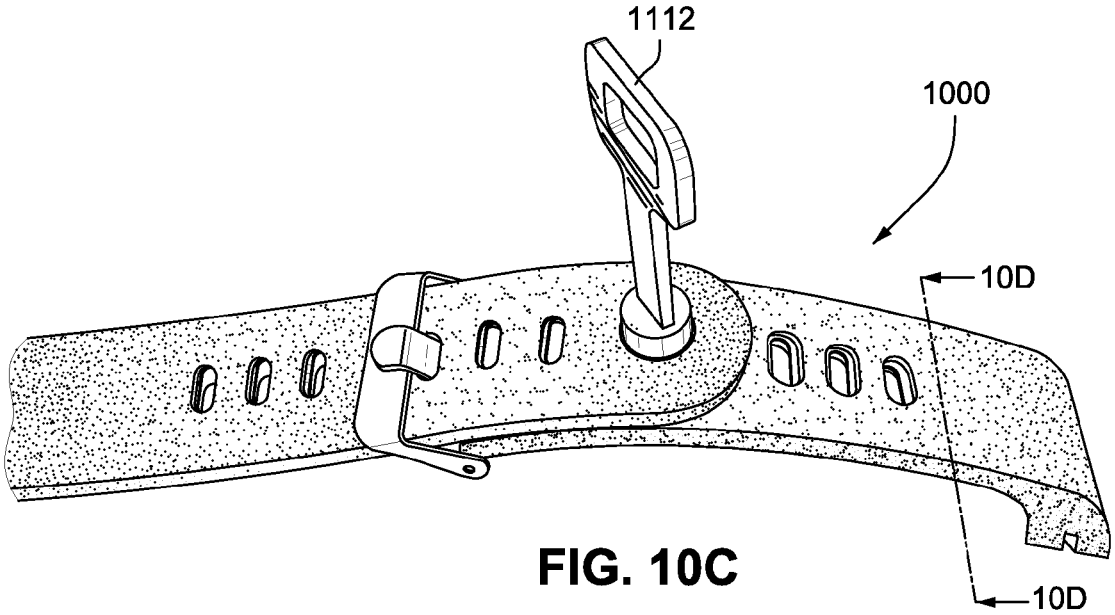
Figure 10D:
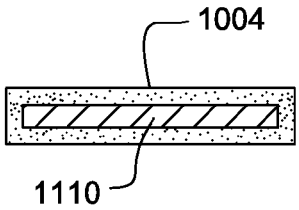
Figure 11:
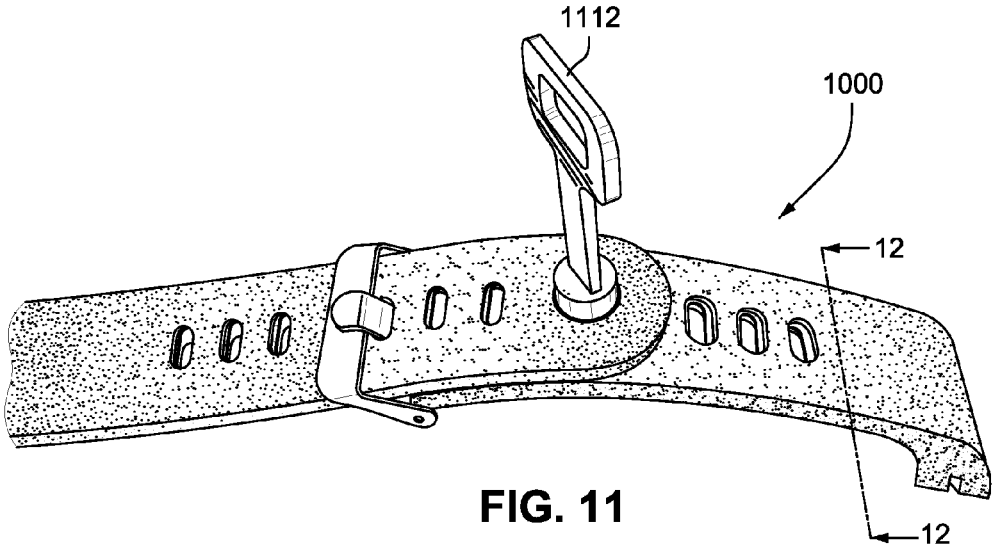

FIGS. 10A-11 are cutout views of an example strap with another example locking fastener according to certain example embodiments. Strap 1000 is another type of strap that may be used in connection with certain example bands. Strap 1000 includes a non-conductive outer layer 1004 over an inner conductive layer 1110 in some embodiments the conductive outer layer 1004 may encapsulate a conductive inner layer 1110 except for exposed conductive areas at each fastening aperture. The layers may be held together through bolts, pins, or pressed indentations 1006.

In certain example embodiments, the non-conductive layer 1004 may be constructed out of leather, plastic, or some other non-conductive material. In certain example embodiments, the non-conductive layer 1004 may be resistant to tearing or cutting so as to allow the use of the strap in a more hostile environment (e.g., a prison). The conductive layer 1110 may be a strong metal (e.g., stainless steel) that runs the length (or most of the length) of the strap 1000.

The strap 1000 may include a series of holes 1002 formed in both the outer non-conductive layers 1004 and the inner conductive layer 1110. The holes are provided to allow a bolt 1008 or the like to be threaded or inserted there through. With the bolt 1008 in place, the head 1114 of bolt 1008 can be tightened with a specially-mated key 1112 to secure the respective ends of strap 1000. It will be appreciated that the bolt 1008 may function to bridge the two conductive ends of the strap 1000 through the exposed conductive areas at the fastened mated apertures to thereby complete an electrical circuit (e.g., the bolt is conductive and in contact with exposed conductive areas in both ends of the strap).

In certain example embodiments, the inner conductive layer may extend out of holes 1002 such that the metallic inside layer is flush or extends above the "outer" non-metallic layers where holes 1002 are formed. Such an implementation may improve an electrical connection formed via bolt 1008 that is formed between the two ends of the conductive inner layer 1110 (e.g., because more surface area of the conductive layer contacts the bolt).

Figure 12:
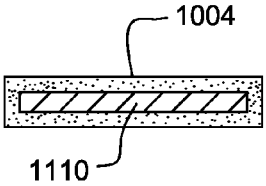
FIG. 12 is an example cross-sectional view of the example strap of FIG. 10A.

FIG. 12 is a cross sectional view taken along line 10D in FIG. 11 showing non-conductive layer 1004 encasing the conductive or metallic layer 1110. In certain example embodiments, the metallic layer may be exposed along the sides. In other words, the non-conductive layer may not completely encompass the conductive layer along the 10D cross-sectional line.

Figure 13:
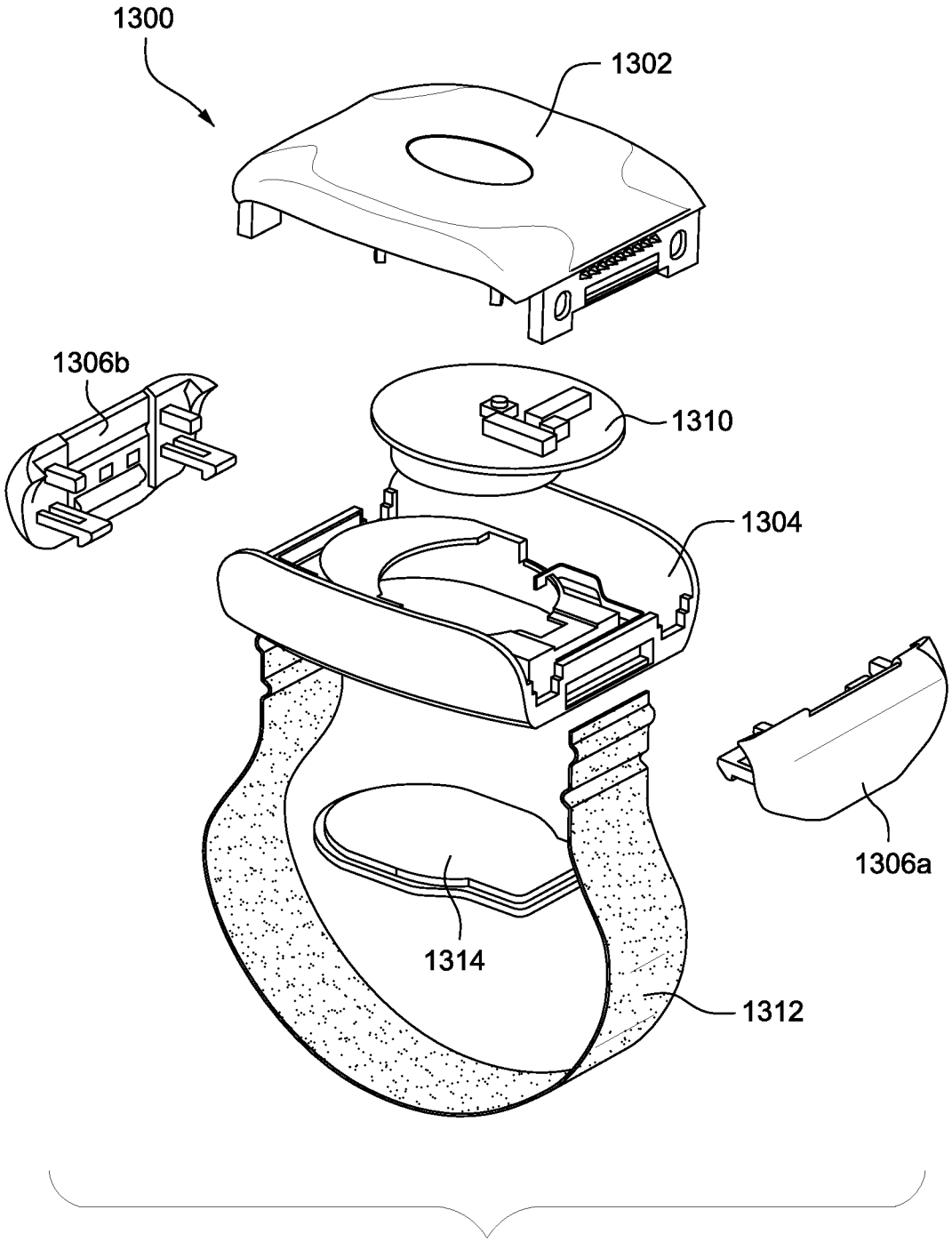
FIG. 13 is an exploded view of a further example band.

FIG. 13 is an exploded view of a further example band. Band 1300 includes a cover assembly 1302, a base assembly 1304 that attaches to the cover assembly, a pair of opposingly situated transverse doors 1306*a* and 1306*b* that interface with opposing sides of the base and cover assemblies, and a PCB assembly 1310 that is disposed in between. The PCB assembly may include, e.g., an RFID device that is either active or passive. An "active" battery 1314 may be provided at the bottom of base assembly 1304 and may be used to power PCB assembly 1310. A conductive strip 1312 is also provided and designed to secure the band 1300 to the wrist or ankle of a person.

The conductive strip 1312 may externally include high-density polyethylene fibers and an internal layer of conductive material such as aluminum foil. In certain example embodiments, the conductive strip is constructed out of Tyvek® that is available from DuPont. The strip may be formed by layering a conductive layer (e.g., aluminum foil) between two layers of Tyvek and sealing the Tyvek® and conductive layers into a single body (e.g., by folding the sides of a Tyvek® strip over a narrower strip of conductive foil and gluing together the overlapped sides).

High-density polyethylene (e.g., Tyvek®) may be an attractive material to use in constructing the (internally) conductive strip 1312 because of its waterproof properties and relative strength and durability. The polyethylene can stabilize the relatively low durability aluminum foil that may be layered between the outside layers. It will be appreciated that other types of material may be used. The conductive strip should include a material that is flexible, strong, durable, and at least internally conductive. As noted above, two more materials may be combined to achieve such properties.

Figure 14A:
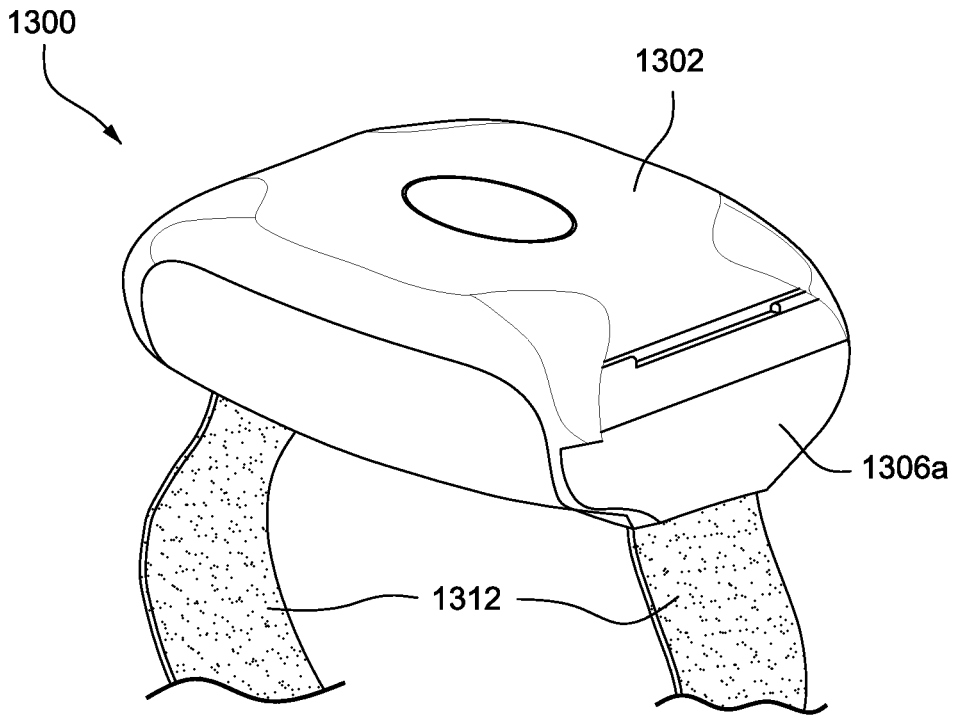
FIG. 14A is a perspective view showing the example band of FIG. 13 in a closed configuration.

FIG. 14A is a perspective view showing the example band of FIG. 13 with doors 1306*a* and 1306*b* in a closed configuration. Here the band 1300 is "closed" with the doors set in a locked position and in this example a continuous length of conductive strip 1312 is secured at opposite ends to the assembly. In this configuration it will be difficult or impossible to remove the conductive strip from the assembly without cutting it and thus setting off a tamper alarm (e.g., due to the strip 1312 being inserted within locking "one-way" passages at each end of the assembly). This feature will be described in more detail below.

Figure 14B:
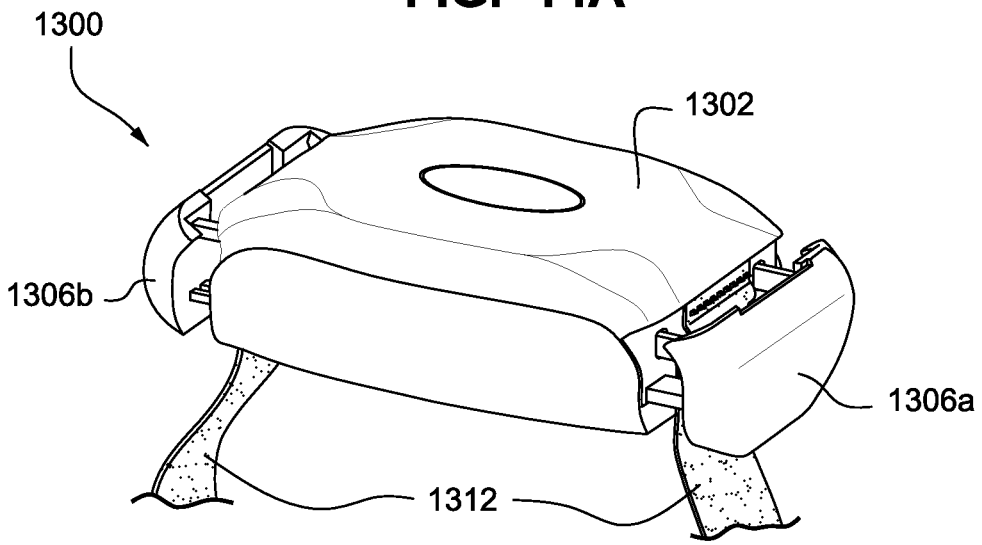
FIG. 14B is a perspective view showing the example band of FIG. 13 in an open configuration.

FIG. 14B is a perspective view showing the example band of FIG. 13 in a doors open configuration. The doors 1306*a* and 1306*b* are here shown as moved outwardly positioned from the main assembly body to allow insertion of ends of a length of strip 1312 between the doors 1306*a*/1306*b* and the assembly body or the subsequent removal of strip 1312 (once it has been cut to permit removal via the "one-way" aperture in the slot passage between body 1302 and doors 1306*a* and 1306*b*).

Figure 15:
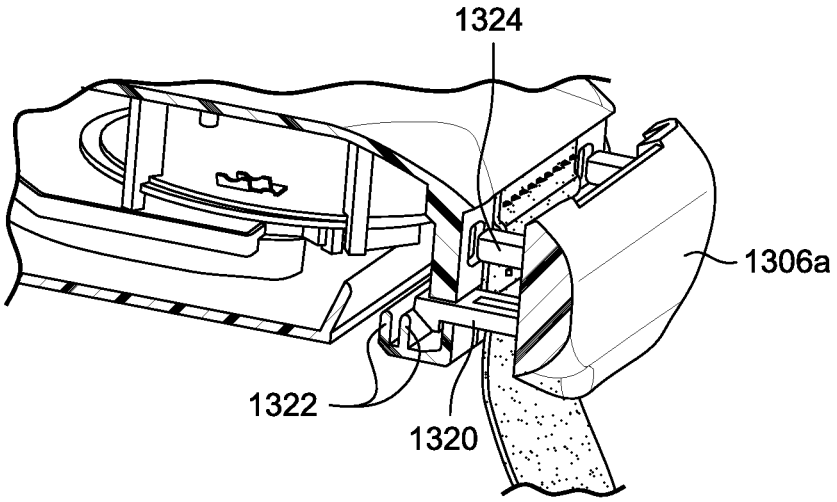
FIGS. 15-16 are cross sectional views showing an example door of the band in FIG. 13 interacting with an example body and one-use band when the door is in an open position.
Figure 16:
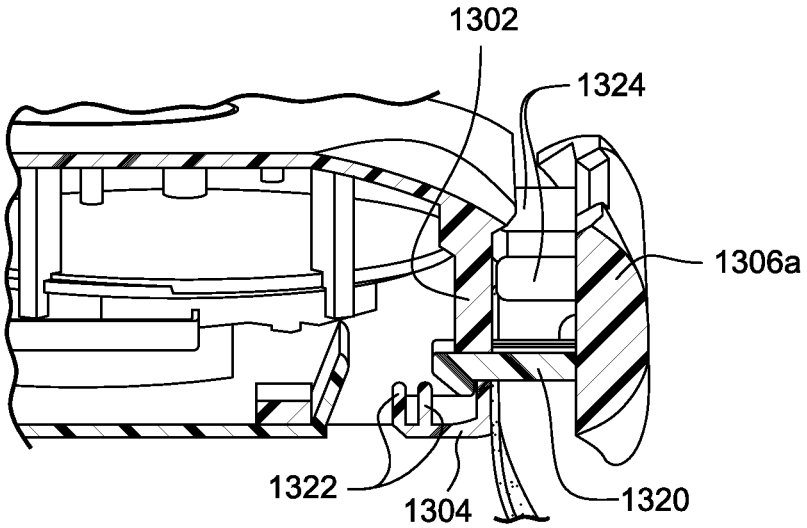

FIGS. 15-16 are cross sectional views showing an example door of the band in FIG. 13 interacting with an example body when the door is in an open position. One or more snap prongs 1320 are attached to doors 1306*a*/1306*b*. The snap prongs 1320 are structured to pass between an opening that is formed between cover assembly 1302 and base assembly 1304. Pins 1324 are also provided in the door and, as described below, fit into apertures formed into the cover assembly. In a preferred embodiment each door includes two snap prongs and two pins 1324. As will be seen, an open slot is formed when the door 1306*a* is open.

Figure 17:
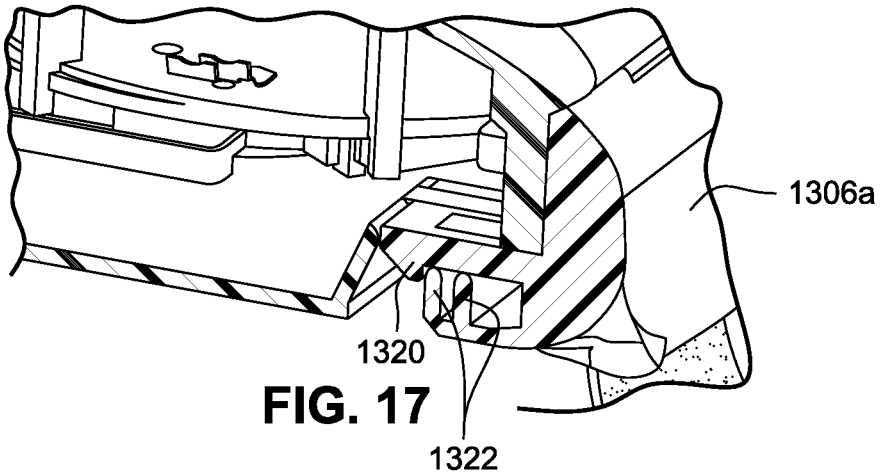
FIGS. 17-18 are cross sectional views showing an example door of the band in FIG. 13 interacting with an example body and one-use band when the door is in a closed position.
Figure 18:
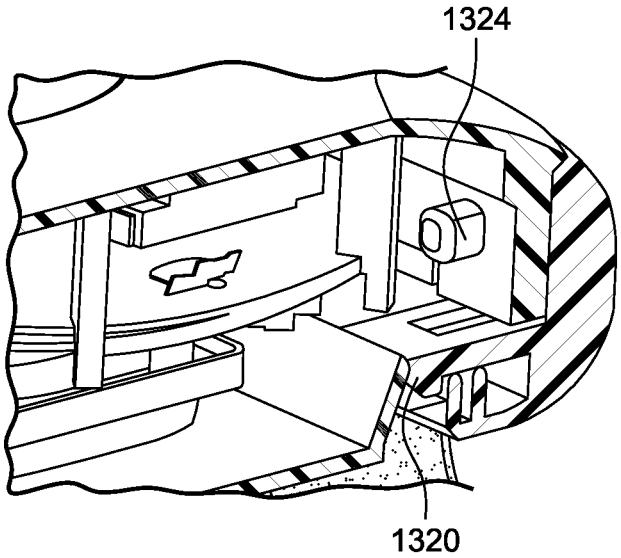

FIGS. 17-18 are cross sectional views showing an example door 1306*a* of the band in FIG. 13 interacting with an example body when the door is in a closed position. When the door 1306*a* is pushed inwardly against the completed cover assembly 1302 and base assembly 1304, the snap prongs 1320 snap over projections 1322 and thereby secure the door to the cover and base assemblies. Pins 1324 are snugly fitted into apertures of the cover assembly for added stability, strength, and durability. In other words, the pins 1324 may provide extra support to prevent unnecessary movement of the door when it is "locked" or closed position.

When the snap prongs are in place with shown indentations fitted behind projections 1322, the door becomes essentially impossible to open without access to snap prongs 1320 (e.g., with destroying the assembly).

Figure 19:
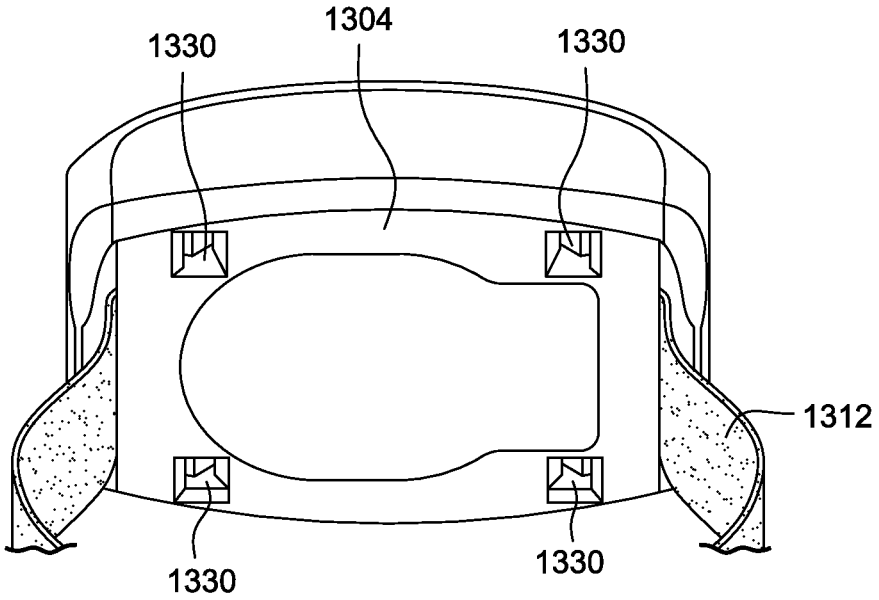
FIG. 19 is a underside view of the example band of FIG. 13.
Figure 20:
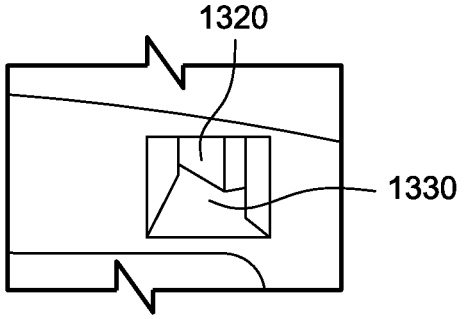
FIG. 20 is a cutout view of a hole placed on the underside of the band shown in FIG. 13.

FIG. 19 is an underside view of the example band of FIG. 13 and FIG. 20 is a cutout view of holes 1330 placed on the underside of the band shown in FIG. 13 to access the snap prongs 1322 when they are in the locked or closed position as shown in FIGS. 17-18. Here, four holes 1330 are placed in the bottom of the base assembly 1304 to allow access to snap prongs 1320. A person may access the snap prongs 1320 through holes 1330 (e.g., with a special tool) and apply an upward pressure to push the indentations in the prongs 1320 up high enough so as to clear the projections 1322. Once clear of projections 1322 the respective doors may be again moved to the open positions. In certain example embodiments, a special access tool (mated to the holes 1330 on at least one side of the band) is provided to allow desired simultaneous access to the locking prongs for the respective doors.

Figure 21:
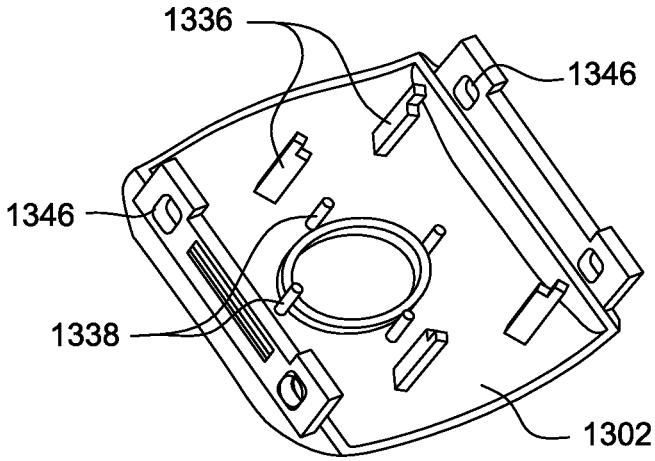
FIGS. 21-23 are perspective views of an example cover for the band shown in FIG. 13.
Figure 22:
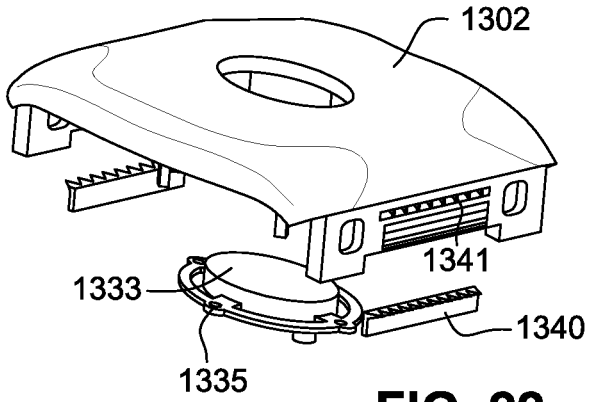
Figure 23:
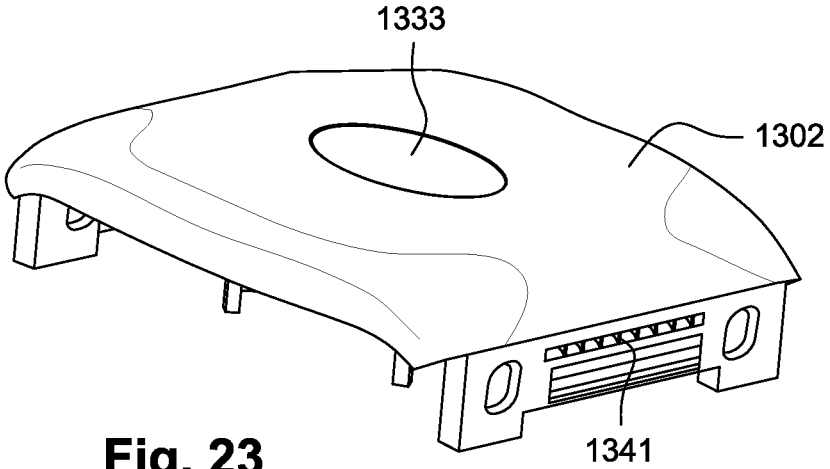

FIGS. 21-23 are perspective views of an example cover for the band shown in FIG. 13. The cover assembly 1302 includes holes 1346 for securing pins 1324 to the assembly when the doors of the band are placed into the closed position. Placement pins 1338 are provided to secure button 1333 to an open aperture in the top of the cover assembly with holes 1335. Ribs 1336 are used to hold PCB assembly 1310 in place.

One-way ripping parts 1340 are secured to the cover assembly through molded apertures 1341 included in the molded cover assembly 1302. The one-way ripping parts 1340 may be made out of stainless steel or any other material for one-way ripping the conductive ribbon (e.g., that includes Tyvek® aluminum foil).

Figure 24:
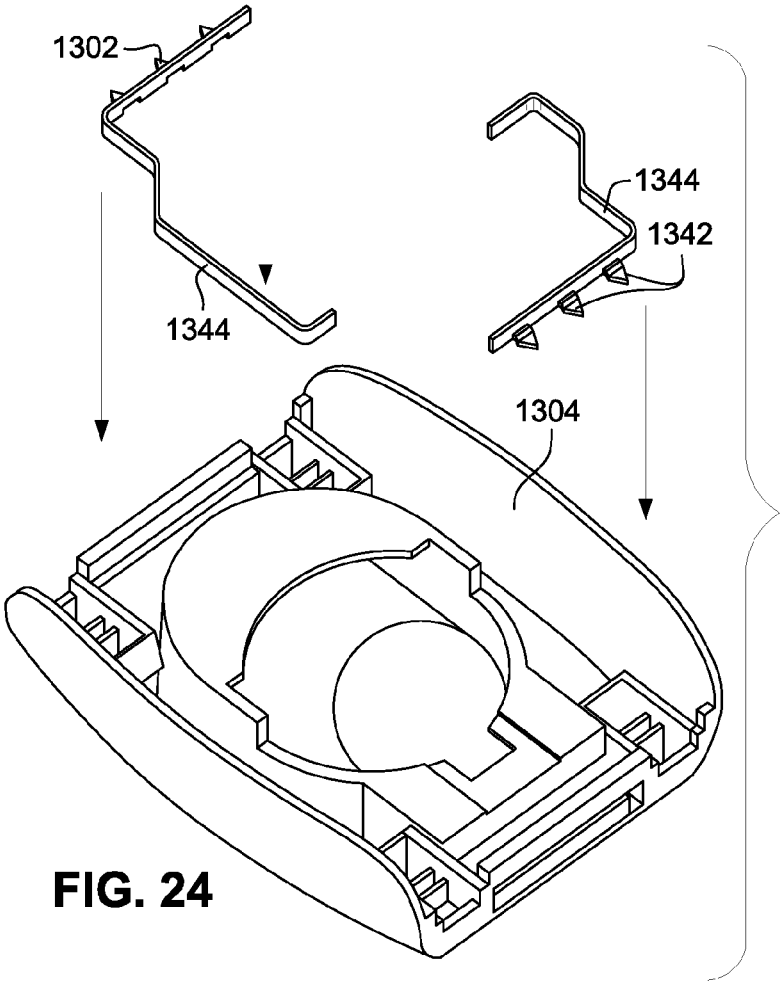
FIGS. 24-25 are perspective views of an example base body for the band shown in FIG. 13.
Figure 25:
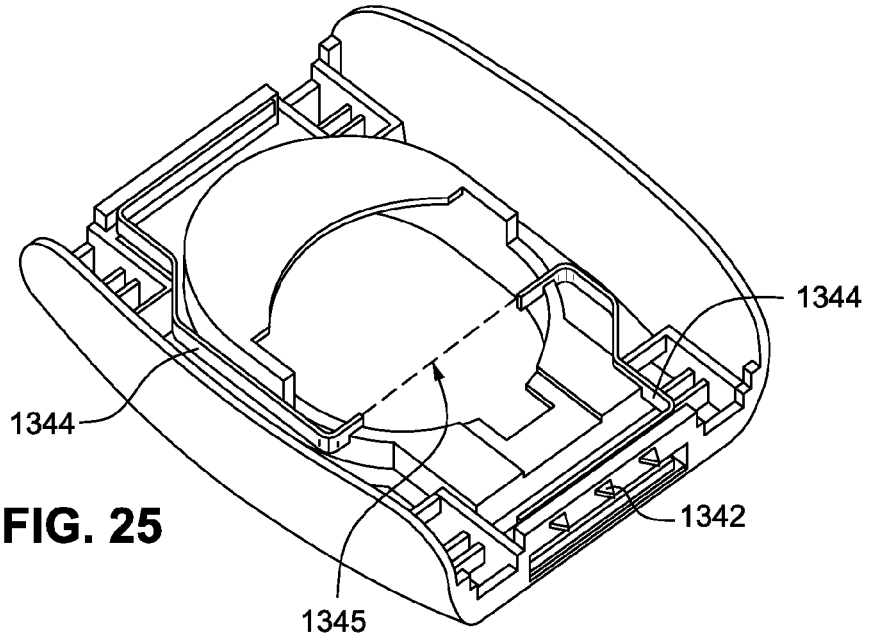

FIGS. 24-25 are perspective views of an example base body for the band shown in FIG. 13. The base assembly 1304 is structured to have a pair of conductive elements 1344 installed into the body of the base assembly 1304. The conductive elements are structured to form part of a closed circuit with conductive strip 1312 and PCB assembly 1310 that is placed along line 1345. In other words, the pair of conductive elements 1344 will be conductively linked because the installed PCB assembly 1310 bridges the gap along line 1345. The conductive elements also have three teeth that are configured to stab into the conductive strip 1312 to complete the conductive circuit to/from PCB assembly 1310. Accordingly, the conductive elements 1344 are placed into a molded structure of the base assembly 1304 where one end of each element 1344 interfaces with the PCB assembly 1310 and at least one of the teeth 1342 each will interface with the conductive strip 1312 to complete the tamper detection of element 1344 circuit.

While the example in FIG. 24 shows the conductive elements with 3 teeth it will be appreciated that one tooth may be used or multiple teeth may be added to the conductive elements 1344. In certain example embodiments the teeth may be another type of structure, for example, a pin, column, extrusion, or the like provided to allow the conductive elements 1344 to conductively interface with respectively associated ends of the conductive strip 1312.

Figure 26:
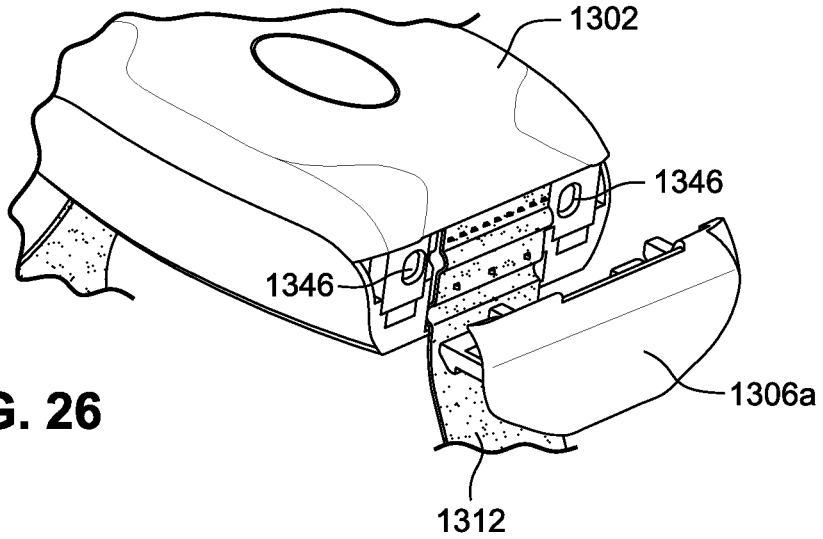
FIG. 26 is a cutout perspective view of an example door interacting with an example body of the band shown in FIG. 13.
Figure 27:
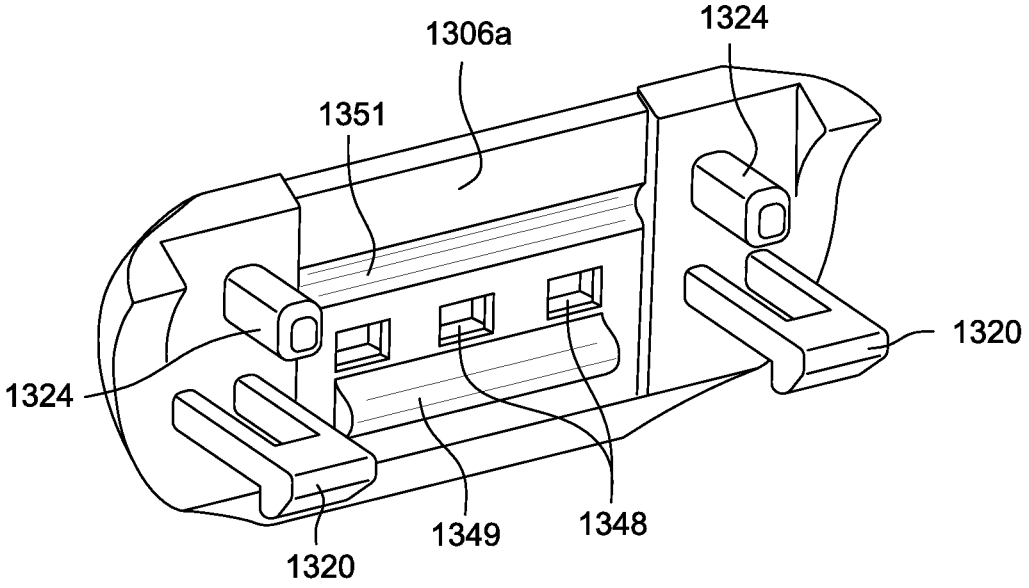
FIG. 27 is an inside perspective view of the door of the band shown in FIG. 13.
Figure 28:
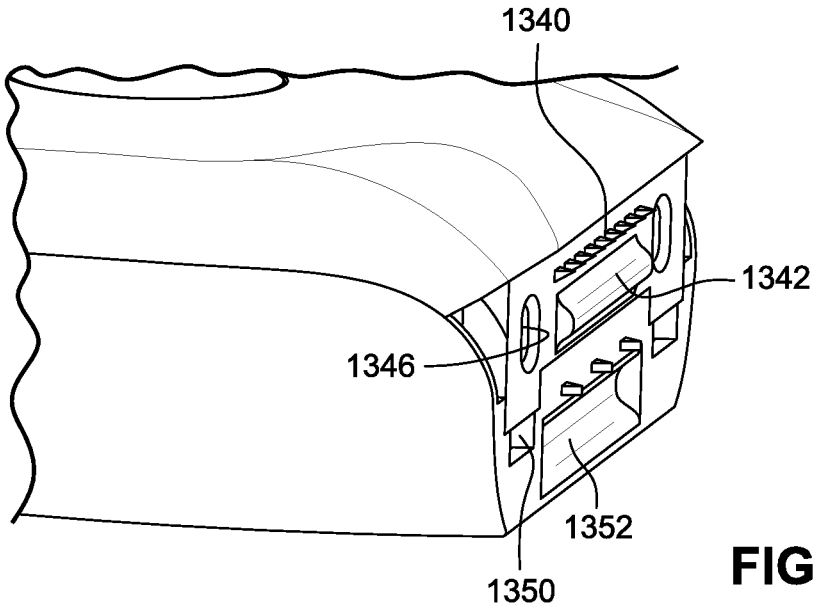
FIGS. 28 and 29 are cut out perspective views of the band shown in FIG. 13.
Figure 29:
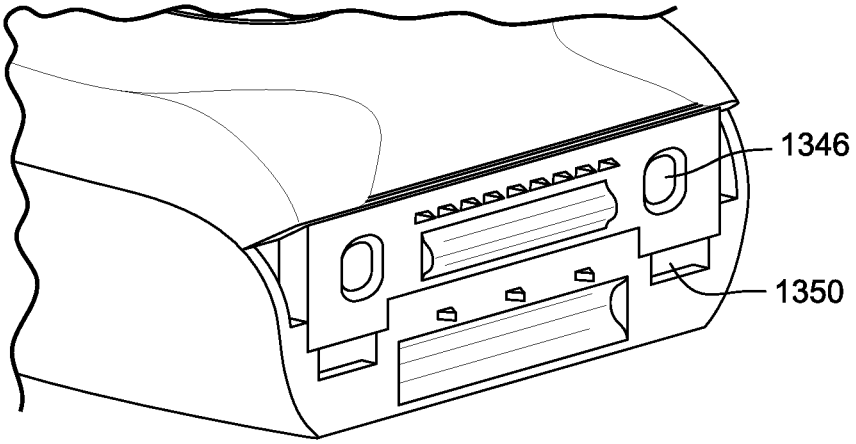

FIG. 26 is a cutout perspective view of an example door interacting with an example body of the band shown in FIG. 13. FIG. 27 is an inside perspective view of the door. The door 1306*a* includes a pressure groove 1351 and a pressure bulge 1349. These pressure structures are configured to create pressure points when the door 1306*a* is placed into a locked or closed position with the assemblies shown FIG. 26. As described above pins 1324 and snap prongs 1320 interface with the assemblies to hold the door 1306*a* in the locked or closed position. Holes 1348 are provided to accept the conductive teeth 1342 when the door 1306*a* is placed in the closed position FIGS. 28 and 29 are cut out perspective views of the band shown in FIG. 13. As explained above, the one-way ripping part 1340 provides a means for cutting off excess ends of the conductive strip (e.g., to remove excess lengths). Pressure bulge 1342 is designed to structurally match the pressure groove 1351 of the door 1306*a*. Also Pressure groove 1352 is structured to match (at least substantially) the pressure bulge 1349 of the door 1306*a*. Gap 1350 may be created by joining the cover assembly and base assembly and is structured to then accept snap prongs 1320.

Figure 30:
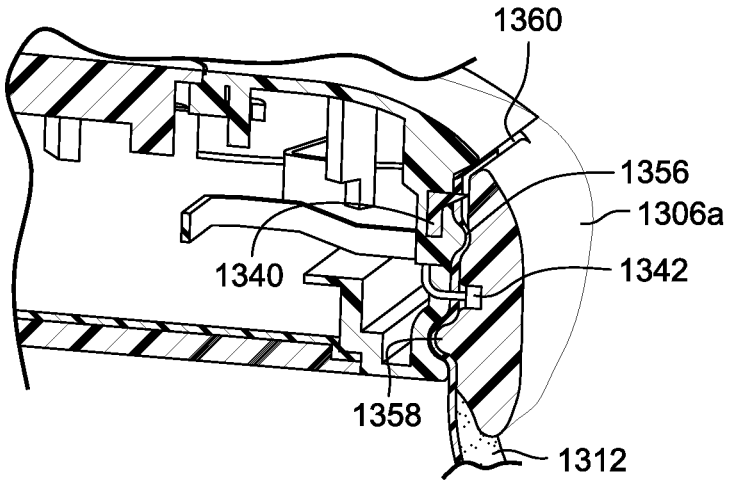
FIG. 30 is a cutout cross-sectional view showing interaction of the body of the band, the conductive strip, and the door of FIG. 13.
Figure 31:
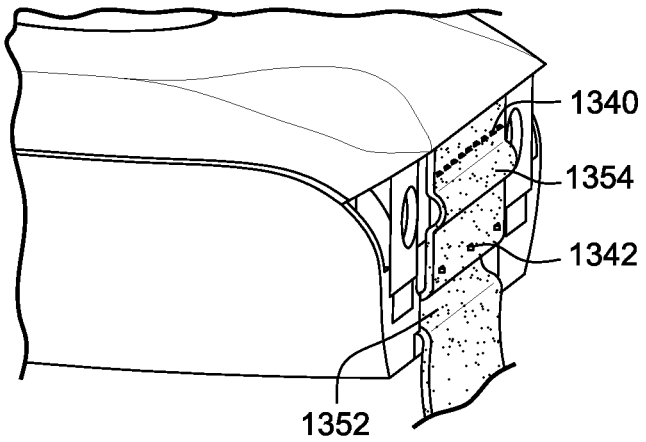
FIG. 31 is a cutout perspective view showing interaction of the body of the band and the conductive strip of FIG. 13.

FIG. 30 is a cutout cross-sectional view showing interaction of the body of the band, the conductive strip, and the door of FIG. 13. FIG. 31 is a cutout perspective view showing interaction of the body and the conductive strip 1312. Pressure points 1356 and 1358 are provided where the pressure bulge 1342 and pressure groove 1351 meet and where pressure groove 1352 meets pressure bulge 1349. Conductive teeth 1342 of the conductive element stab into the conductive strip 1312 to form a conductive connection between the conductive strip and the conductive element. The one-way ripping part 1340 may then cut off excess portions of the conductive strip 1312 which may be extracted via strip slot 1360. In other words, when excess amounts of conductive strip emerges from the extracting strip slot a person may tear the conductive strip by applying force to cause the ripping part to rip the conductive strip where the two elements intersect to weaken the conductive strip.

Figure 32:
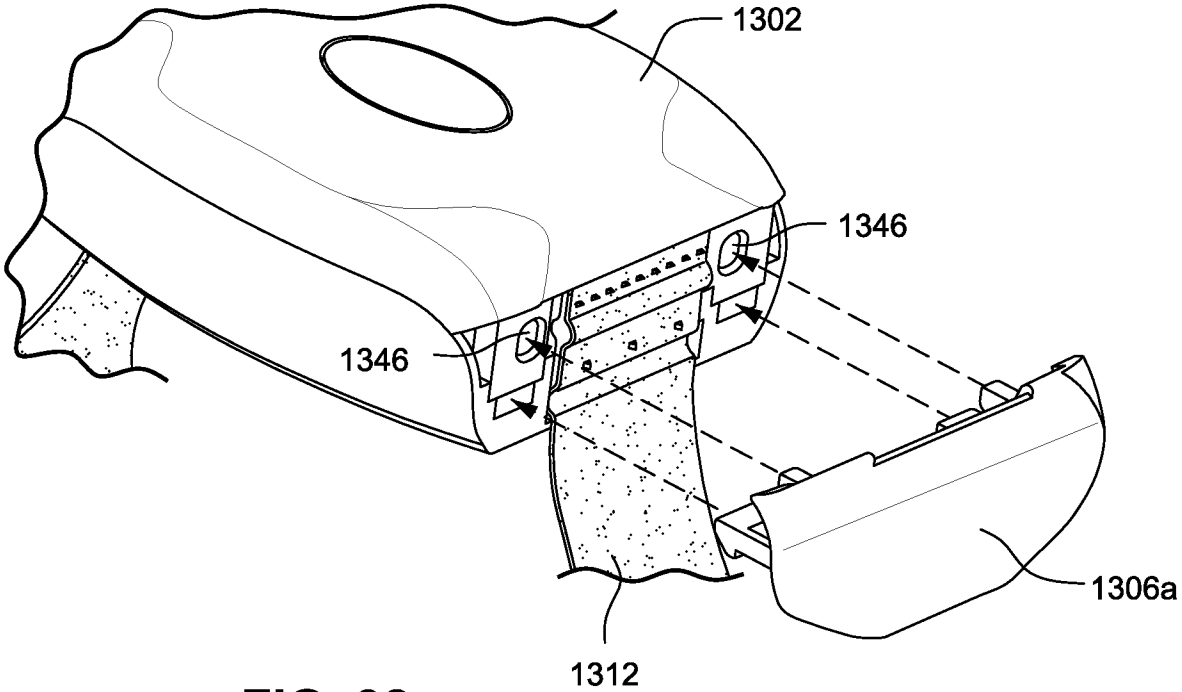
FIG. 32 is a perspective view showing interaction of the door and body of the band shown in FIG. 13.

FIG. 32 is a perspective view showing interaction of the door and body of the band shown in FIG. 13. As described above, door 1306*a* with snap prongs 1320 and pins 1324 interfaces with holes 1346 and gap 1350. The created pressure points by the respective pressure grooves and bulges act to hold the conductive strip in place while the band 1300 is worn by a user.

In certain example embodiments, the band may include an LCD screen and/or additional switch buttons disposed on the cover assembly, the body assembly, or the doors. Other techniques for completing a conductive tamper detection circuit may also be used. For example, conductive teeth may be integrated into the door and a conductive bridge may be formed via the snap prongs to extrusions in either the base or cover assembly.

In certain example embodiments, a data/signal processor (e.g., an electronic device) may be configured with security features/programs such that information stored in an example wrist band is selectively retrieved based on an access level associated with a requesting user or device. User Access Level (UAC) permissions may be implemented such that a signal sent from an RFID reader includes a security key that may prompt an example RFID chip to display the requested and approved information in accordance with the requesting sender (e.g., information that they are authorized to see). For example, the medical staff in a hospital may access to anything stored on the RFID tag while the administrative staff may only have access to fields such as first name, last name, phone number, and & start date.

In certain example embodiments, the information may be displayed on a display device of the wristband or may be wirelessly transmitted back to the requesting device. Such wireless communication may be carried out via Bluetooth®, Wi-Fi, cellular, near field communication (NFC), and/or the like.

Permission access in this manner may be flexible based on the needs of an organization or environment. For example an amusement park may have one type of security protocol and permission configuration and a hospital another.

In certain example embodiments, an RFID reader or a server system may send a low frequency (LF) signals to an RFID chip located on a band and wake it up asking it to display specific information on a display device.

In certain example embodiments, the current battery charge status may be displayed and present information to the wearer of the wristband (or other persons). For example, if the battery power level falls below 20%, the RFID on the band may transmit a maintenance notification to a server (e.g., that this particular battery needs to recharged or replaced).

In certain example embodiments, LED lights and/or an LCD screen can be programmed to behave in accordance to the information stored in an RFID chip. For example one or more LED can be activated to emit different colors to provide a clear indication for the staff that a patient is diabetic or to indicate specific types of allergies that require staff attention (e.g., yellow for a diabetic or red for allergy information). Such visual indicators can provide care takers with a way to quickly assess what actions may or may not need to be taken for a given patient.

In certain example embodiments a switch button may be included on the wristband to allow patient or other persons (e.g., children) to trigger a request (e.g., an urgent request) for assistance. After activating the button, the RFID on the wristband may wirelessly send an alert to a central server (e.g., via a RFID receiver). The central system may then submit an alert for staff or other persons to take action. The alert may include the name of the patient and/or their location. Other information, such as, for example, currently known medical conditions or the like may also be included.

An example band may be associated with a real-time location system (RTLS) or tracking system. For example, rooms within a structure or building may be equipped with infrared (IR), radio, or the like signaling units. Each unit may be associated with a unique ID that can be used to identify its place or location (e.g., floor 4, hallway B). When user worn bands pass within a coverage area (e.g., within a 15-by-15-room that includes a signaling unit) the location of the band (or the location of the signaling unit) may be reported to a server for tracking.

In certain example embodiments, a wristband may wirelessly communicate with a personal computing system as opposed to, or in conjunction with, a centralized server. For example, a wrist band may communicate with a smart phone, tablet computer, personal computer (e.g., laptop or desktop), beeper, or the like. In certain example embodiments, wireless communication may be carried out via Bluetooth®, Wi-Fi, cellular (e.g., GSM), near field communication (NFC), and/or the like. In certain examples, multiple wireless communication techniques may be used to facilitate the transfer of data between the wristband and another device—e.g., NFC may be used to bootstrap a Bluetooth connection.

It will be appreciated that while the term "wristband" may be used in connection with certain example embodiments, that those embodiments may be adapted for use for any extremity of a person. For example, a wristband may be adapted to be worn around the ankle of a person.

While the invention has been described in connection with what is presently considered to be the preferred embodiment(s), it is to be understood that the invention is not to be limited to the disclosed embodiment(s), but on the contrary, is intended to cover various modifications and equivalent arrangements as now will be apparent to those skilled in the art and included within the spirit and scope of the claims.

What is claimed is:

1. An apparatus adapted for secure affixation around a human extremity via a flexible electrically conductive strap, said apparatus comprising:

a housing assembly;

an electronic circuit disposed in the housing assembly and configured to perform wireless communication;

a pair of conductive elements electrically coupled to the electronic circuit and disposed on opposing sides of the housing assembly, each of the conductive elements including at least one protruding conductive structure configured to pierce, and electrically connect with, the flexible electrically conductive strap; and a pair of movable clamping structures disposed at each of said opposing sides of the housing and movable (a) from an open position defining a slot through which a free end of the inserted electrically conductive strap is inserted and (b) to a closed and locked position covering the respectively associated conductive structure and clamping an inserted end portion of the inserted conductive strap therein to complete an electrical circuit with said electronic circuit though said conductive strap and said conductive elements.

2. The apparatus of claim 1, further comprising:

a one-way ripping element disposed on each of the opposing sides of the housing and configured to permit only one-way passage of said inserted electrically conductive strap though said defined slot and to assist in severing an excess strap portion extending above said define slots after said movable clamping structure is closed.

3. The apparatus of claim 1, wherein:

each movable clamping structure includes a first pressure bulge and a first pressure groove;

each of the opposing sides includes a second pressure bulge and a second pressure groove; and in the closed and locked position of each movable clamping structure, the first pressure bulge interfaces with the second pressure groove and the first pressure groove interfaces with the second pressure bulge.

4. The apparatus of claim 3, wherein the second pressure groove and the second pressure bulge of each movable clamping structure are positioned on opposing sides of a respectively corresponding one of the conductive elements to secure there-between a clamped portion of the strap when the movable clamp structure is in the closed and locked position.

5. The apparatus of claim 1, in combination with the inserted electrically conductive strap to define an assembled extremity band.

6. The combination of claim 5, wherein the electrically conductive strap includes at least one polyethylene layer and at least one conductive ribbon configured to electrically contact with the conductive elements when pierced thereby.

7. An apparatus adapted for secure affixation around a human extremity via a flexible electrically conductive strap, the apparatus comprising:

a housing;

an electronic circuit disposed in the housing and configured to perform wireless communication;

a pair of conductive elements electrically coupled to the electronic circuit and disposed on opposing sides of the housing, each of the conductive elements including at least one protruding conductive structure configured to electrically connect with the flexible electrically conductive strap; and a clamping structure disposed at each of the opposing sides of the housing and moveable between (a) an open position in which a free end of the electrically conductive strap can be inserted and (b) to a closed position in which the clamping structure covers the respectively associated protruding conductive structure and clamps an inserted end portion of the inserted conductive strap therein to complete an electrical circuit with the electronic circuit though the conductive strap and the conductive elements.

8. The apparatus of claim 7, further comprising:

a wireless transmitter disposed within the housing as part of the electronic circuit, the wireless transmitter configured to:

send a first wireless data message in response to determination of completion of the electrical circuit; and send a second wireless data message in response to determination of interruption of the electrical circuit.

9. The apparatus of claim 7, further comprising:

a radio frequency identification (RFID) tag disposed with the housing as part of the electronic circuit.

10. The apparatus of claim 7, wherein the clamping structures are each movable in a direction transverse to a respectively associated opposing side of the housing.

11. The apparatus of claim 7, wherein an openable and closable slot path is defined by an outer surface of the housing and an inner surface of one of the clamping structures.

12. The apparatus of claim 7 in combination with a position tracking system, comprising;

a wireless transmitter disposed in the housing of the apparatus as part of the electronic circuit;

at least one remote wireless receiver configured to receive transmissions from the wireless transmitter of the apparatus; and a remote computer system coupled to the at least one wireless receiver and configured to determine a position of the apparatus based on the received transmissions.

13. An apparatus adapted for secure affixation around a human extremity via a flexible electrically conductive strap, the apparatus comprising:

a housing assembly;

an electronic circuit disposed in the housing assembly and configured to perform wireless communication;

a pair of conductive elements electrically coupled to the electronic circuit and disposed on opposing sides of the housing assembly, each of the conductive elements including at least one protruding conductive structure configured to electrically connect with the flexible electrically conductive strap; and a pair of movable clamping structures disposed at each of the opposing sides of the housing and movable (a) from an open position where a free end of the flexible electrically conductive strap can be inserted into a slot path (b) to a closed and locked position covering the respectively associated protruding conductive structure and clamping an inserted end portion of the inserted flexible electrically conductive strap therein to complete an electrical circuit with the electronic circuit though the conductive strap and the conductive elements.

14. The apparatus of claim 13, wherein the electronic circuit disposed in the housing includes a radio frequency identification (RFID) tag.

15. The apparatus of claim 13, wherein each of the pair of movable clamping structures includes at least one prong structure configured to pass through an aperture in the housing assembly to facilitate closing the pair of movable clamping structures.

16. The apparatus of claim 13, wherein the electronic circuit disposed in the housing is configured to:

detect that the electrical circuit has been completed; and detect that the electrical circuit, if previously completed, has been interrupted.

* * * * *